US010160217B2

(12) United States Patent
Aoyagi et al.

(10) Patent No.: US 10,160,217 B2
(45) Date of Patent: Dec. 25, 2018

(54) TABLET PRINTING APPARATUS AND TABLET PRINTING METHOD

(71) Applicant: SHIBAURA MECHATRONICS CORPORATION, Yokohama-shi (JP)

(72) Inventors: Hitoshi Aoyagi, Yokohama (JP); Azusa Hirano, Yokohama (JP); Yasutsugu Tsuruoka, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/716,728

(22) Filed: Sep. 27, 2017

(65) Prior Publication Data

US 2018/0015726 A1 Jan. 18, 2018

Related U.S. Application Data

(63) Continuation of application No. PCT/JP2016/060425, filed on Mar. 30, 2016.

(30) Foreign Application Priority Data

Mar. 31, 2015 (JP) ..... 2015-071934
Oct. 16, 2015 (JP) ..... 2015-205046

(51) Int. Cl.
*B41J 2/175* (2006.01)
*A61J 3/00* (2006.01)
(Continued)

(52) U.S. Cl.
CPC ..... *B41J 2/175* (2013.01); *A61J 3/007* (2013.01); *A61J 3/06* (2013.01); *B05C 5/00* (2013.01);
(Continued)

(58) Field of Classification Search
CPC .... B41J 2/17566; B41J 2/17509; B41J 2/175; A61J 3/007
See application file for complete search history.

(56) References Cited

U.S. PATENT DOCUMENTS 9,033,447 B2 * 5/2015 Morita ..... B41J 11/42 347/16
2011/0128557 A1 * 6/2011 Kinoshita ..... A61J 3/007 358/1.5

FOREIGN PATENT DOCUMENTS

JP 2001-105627 4/2001
JP 2002-120374 4/2002
(Continued)

OTHER PUBLICATIONS

International Search Report dated Jun. 14, 2016 in PCT/JP2016/060425 filed Mar. 30, 2016 (with English Translation).

*Primary Examiner* — Jason S Uhlenhake
(74) *Attorney, Agent, or Firm* — Oblon, McClelland, Maier & Neustadt, L.L.P.

(57) ABSTRACT

According to one embodiment, a tablet printing apparatus includes: a conveyor; an inkjet head configured to eject ink from a nozzle to a tablet conveyed by the conveyor to perform printing; an ink tank configured to contain the ink to be supplied to the inkjet head; a moving device configured to change the height of the ink tank; and a control unit configured to control the moving device. The control unit controls the moving device to change the height of the ink tank based on a use amount of the ink figured out in advance to maintain a head difference between the height of the liquid level of the ink in the ink tank and the height of a nozzle forming surface, where the nozzle is formed in the inkjet head, at a predetermined value.

14 Claims, 9 Drawing Sheets

(51) Int. Cl.

| | |
|---|---|
| ***A61J 3/06*** | (2006.01) |
| ***B05C 5/00*** | (2006.01) |
| ***B05C 11/10*** | (2006.01) |
| ***B05D 1/26*** | (2006.01) |

(52) U.S. Cl.
CPC ..... *B05C 11/10* (2013.01); *B05D 1/26* (2013.01); *B41J 2/17509* (2013.01); *B41J 2/17566* (2013.01); *B05D 2258/02* (2013.01)

(56) References Cited

FOREIGN PATENT DOCUMENTS

| | | |
|---|---|---|
| JP | 2004-017356 | 1/2004 |
| JP | 2005-288983 | 10/2005 |
| JP | 2006-027166 | 2/2006 |
| JP | 2006-168310 | 6/2006 |
| JP | 2008-012793 | 1/2008 |
| JP | 2008-126641 | 6/2008 |
| JP | 2013-121432 | 6/2013 |
| JP | 2013-248757 | 12/2013 |

* cited by examiner

TABLET PRINTING APPARATUS AND TABLET PRINTING METHOD

CROSS-REFERENCE TO THE RELATED APPLICATION

This application is based upon and claims the benefit of priority from International Application No. PCT/JP2016/060425, filed on Mar. 30, 2016, Japanese Patent Application No. 2015-071934, filed on Mar. 31, 2015 and Japanese Patent Application No. 2015-205046, filed on Oct. 16, 2015; the entire contents of all of which are incorporated herein by reference.

FIELD

Embodiments described herein relate generally to a tablet printing apparatus and a tablet printing method.

BACKGROUND

An apparatus using an inkjet head is known as being used for printing characters, letters, marks or the like on the surface of a tablet. For the inkjet head, in order to properly maintain the discharge amount, it is necessary to keep the water head difference between the height of the ink liquid level in the ink tank and the height of the nozzle surface of the inkjet head within an acceptable range.

For example, in a technique of performing printing on a printing sheet, an acceptable range of the liquid level of ink in an ink tank (sub tank) is set in advance, and the sensor is arranged at the upper limit position and the lower limit position of the acceptable range. When the liquid level deviates from the lower limit of the acceptable range, the ink is supplied up to the upper limit of the acceptable range.

In the case where such a printing technique is applied to printing on a printing sheet or film formation on a large substrate such as a liquid crystal substrate, a large amount of ink is discharged (consumed) at one time. For this reason, the acceptable range needs to be set wide enough.

Incidentally, the water head difference inevitably differs greatly between when the liquid level is at the upper limit position of the acceptable range and when the liquid level is at the lower limit position. This has little influence on printing on a printing object such as a printing sheet, a large substrate, and the like.

However, in the field of tablet printing, a character, a letter, a mark or the like having a size of about 1 mm is printed on tablets with a diameter of, for example, about 5 mm to 8 mm. When printing was carried out on such small printing objects by using the printing technique as described above, blur or ink bleeding occurred, and printing was not properly performed on the tablets.

DETAILED DESCRIPTION

According to one embodiment, a tablet printing apparatus includes: a conveyor; an inkjet head configured to eject ink from a nozzle to a tablet conveyed by the conveyor to perform printing; an ink tank configured to contain the ink to be supplied to the inkjet head; a moving device configured to change the height of the ink tank; and a control unit configured to control the moving device. The control unit controls the moving device to change the height of the ink tank based on a use amount of the ink figured out in advance to maintain a head difference between the height of the liquid level of the ink in the ink tank and a height of a nozzle forming surface, where the nozzle is formed in the inkjet head, at a predetermined value.

According to another embodiment, a tablet printing apparatus includes: a conveyor; an inkjet head configured to eject ink from a nozzle to a tablet conveyed by the conveyor to perform printing; an ink tank configured to contain the ink to be supplied to the inkjet head; a moving device configured to change the height of the ink tank; and a control unit configured to control the moving device. The control unit controls the moving device to rotate the ink tank so as to maintain the height of the liquid level of the ink based on a use amount of the ink figured out in advance to maintain a head difference between the height of the liquid level of the ink in the ink tank and a height of a nozzle forming surface, where the nozzle is formed in the inkjet head, at a predetermined value.

According to still another embodiment, a tablet printing apparatus includes: a conveyor; an inkjet head configured to eject ink from a nozzle to a tablet conveyed by the conveyor to perform printing; a first ink tank filled with the ink; and an ink supply unit including a second ink tank connected to the first ink tank through a pipe and configured to store the ink, and a flow path resistance adjusting mechanism configured to adjust the amount of the ink supplied from the first ink tank to the second ink tank. The ink supply unit supplies the ink from the second ink tank to the inkjet head. The flow path resistance adjusting mechanism adjusts the amount of the ink by moving the ink from the first ink tank to the second ink tank based on a use amount of the ink figured out in advance to maintain a head difference between the height of the liquid level of the ink in the second ink tank and the height of a nozzle forming surface where the nozzle is formed at a predetermined value.

Embodiments of the present invention will be described in detail below with reference to the drawings.

First Embodiment

Figure 1:
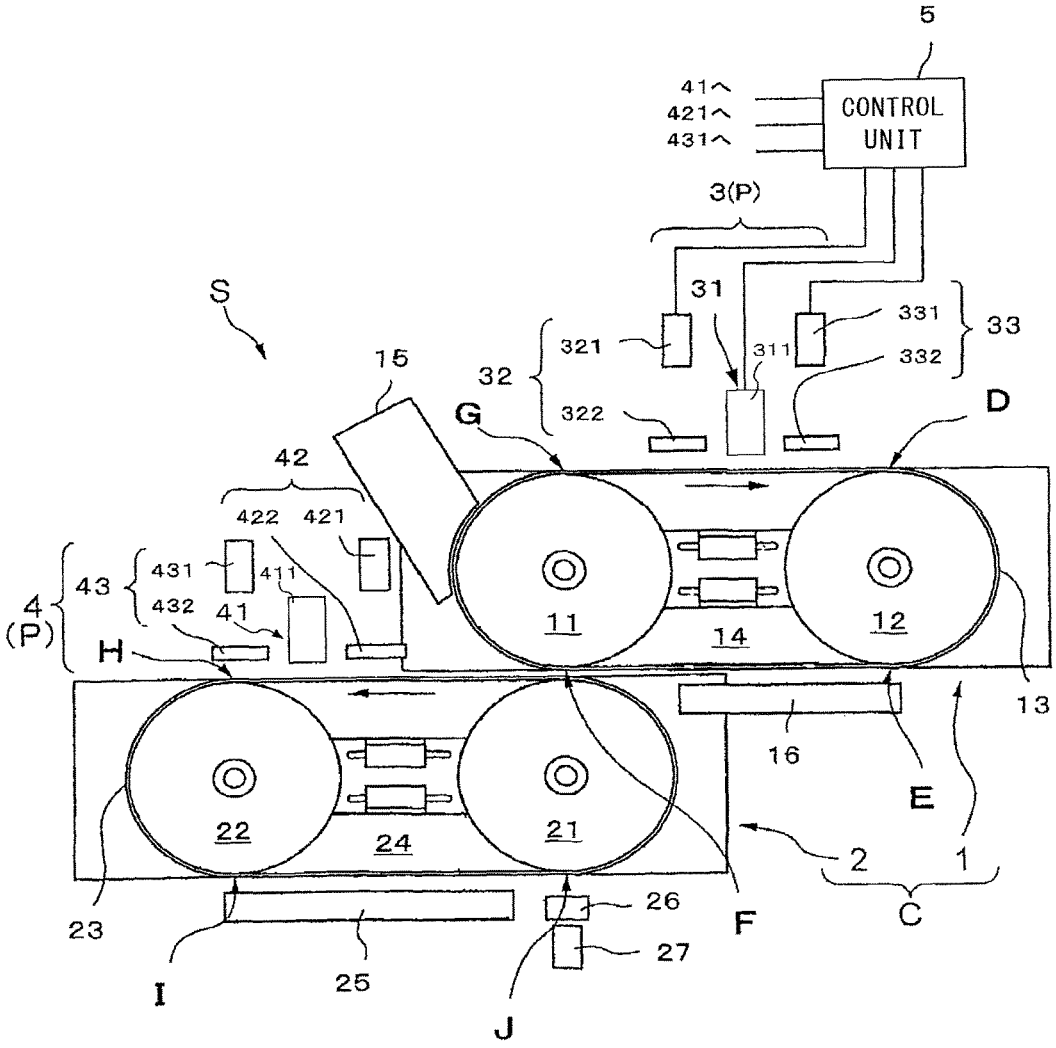
FIG. 1 is a schematic diagram illustrating the overall configuration of a tablet printing apparatus according to a first embodiment.

FIG. 1 is a front view illustrating the overall configuration of a tablet printing apparatus S according to a first embodiment. The tablet printing apparatus S includes a conveyor C for conveying tablets to be printed and a printing unit P for printing on the tablets conveyed by the conveyor C.

As illustrated in FIG. 1, the conveyor C includes a first conveyor 1 and a second conveyor 2. The first conveyor 1 and the second conveyor 2 are arranged one above the other.

The printing unit P includes a first printing unit 3 and a second printing unit 4. The first printing unit 3 is provided to the first conveyor 1, and the second printing unit 4 is provided to the second conveyor 2.

That is, the first printing unit 3 is located above the first conveyor 1, and the second printing unit 4 is located above the second conveyor 2. Thus, the tablet printing apparatus S as a whole is constituted.

In the first embodiment, the first conveyor 1 and the second conveyor 2, or the first printing unit 3 and the second printing unit 4 have the same basic configuration.

The first conveyor 1 includes a first pulley 11, a second pulley 12, an endless conveyor belt 13, and a suction chamber 14.

The first pulley 11 is a left pulley of the two pulleys illustrated as circles in the first conveyor 1 in FIG. 1. The second pulley 12 is a right pulley of the two pulleys illustrated in FIG. 1.

The conveyor belt 13 is wrapped around the first pulley 11 and the second pulley 12. The conveyor belt 13 is provided with no end portion and is endless. Thus, the conveyor belt 13 rotates as the first pulley 11 and the second pulley 12 rotate.

The conveyor belt 13 is provided with a pocket (recess) (not illustrated) on its surface to hold a tablet as a printing object. Further, according to the first embodiment, in order to reliably hold the tablet in the recess during conveyance, the suction chamber 14, which is configured to suck air to thereby hold the tablet in the recess, is provided on the internal circumferential side (rear surface side) of the conveyor belt 13.

Although it is assumed below that there is provided a recess, the recess for sucking and holding may not be formed on the conveyor belt 13, and, for example, only a suction hole (not illustrated) may be formed in the conveyor belt 13.

The suction chamber 14 applies a suction force to the suction hole of the conveyor belt 13. As the suction chamber 14 sucks in air, the tablet is sucked and held in the recess through the suction hole. Because of such a function, the suction chamber 14 is capable of applying a suction force to the suction hole at any position in the entire circumference of the conveyor belt 13.

The first conveyor 1 employs the above configuration, and both the first pulley 11 and the second pulley 12 rotate clockwise. Accordingly, in the first conveyor 1, the conveyor belt 13 moves in a direction indicated by the solid arrow in the upper horizontal region, i.e., rightward from the first pulley 11 to the second pulley 12.

On the upper side of the first conveyor 1, the first printing unit 3 is arranged at a position facing the surface of the conveyor belt 13 which moves from the first pulley 11 towards the second pulley 12. Accordingly, when printing is performed on a tablet in the first printing unit 3, the tablet is placed on the conveyor belt 13 and conveyed below the first printing unit 3.

The first printing unit 3 includes an inkjet printing unit 31 that performs printing on a tablet, a position detector 32 that detects the position of the tablet (e.g., a relative position in the recess in which the tablet is held), and a printing state checking device 33 for checking the state of printing on the tablet.

The inkjet printing unit 31 performs printing on the upper surface of the tablet. The inkjet printing unit 31 includes, for example, an inkjet head 311 which is an ink jet applicator head. The ink used is an edible ink as described above.

The position detector 32 is located on the upstream side of the inkjet head 311 of the inkjet printing unit 31 in the moving direction of the conveyor belt 13. The position detector 32 is configured to detect the position of the tablet to check whether it is properly held in the recess formed in the surface of the conveyor belt 13.

The position detector 32 includes an imaging device 321 for photographing a tablet and an illumination 322 for illuminating the tablet to be photographed. The imaging device 321 photographs the tablet, and sends the captured image to a control unit 5. That is, for example, the control unit 5 serves a part of the configuration of the first printing unit 3 (the position detector 32). On the basis of the detected position (detection result), the control unit 5 determines whether to drive the inkjet printing unit 31 so as to perform appropriate printing (if misalignment has occurred, it performs printing after correcting the misalignment) or not to perform printing.

The printing state checking device 33 is located in the downstream side of the inkjet head 311 in the moving direction of the conveyor belt 13. The printing state checking device 33 is configured to check the state of a print applied to the upper surface of the tablet by the inkjet head 311.

The printing state checking device 33 includes an imaging device 331 for photographing the printing state of the tablet and an illumination 332 for illuminating the tablet to be photographed. The imaging device 331 photographs the tablet, captures an image and sends the captured image to the control unit 5. Accordingly, for example, the control unit 5 serves a part of the configuration of the first printing unit 3 (the printing state checking device 33).

On the basis of the image captured by the imaging device 331, the control unit 5 detects the printing state and determines whether printing is acceptable. As to a tablet determined to be of defective printing, as will be described later, the tablet is transferred to a defective tablet collection box.

Besides, a hopper 15 is provided on the left side of the first pulley 11 of the first conveyor 1. The hopper 15 contains a large number of tablets, and is configured to be able to feed the tablets one by one to the recess of the conveyor belt 13.

Further, on the lower side of the conveyor 1, there is provided a drying device 16 for drying the ink of the tablet after printing. More specifically, the drying device 16 is located in a position facing a region where the conveyor belt 13 moves from the second pulley 12 to the first pulley 11 (a horizontal portion on the lower side of the conveyor 1 between the reference marks E and F in FIG. 1). That is, the drying device 16 is located at a position facing the conveyor belt 13, and is configured to, for example, blow hot air to the tablet to dry the ink printed on the tablet.

The drying device 16 may be arranged in any position as long as it can dry the ink printed on the tablet without interfering with other mechanisms constituting the tablet printing apparatus S.

As illustrated in FIG. 1, the first conveyor 1 is arranged in an upper part of the tablet printing apparatus S, and the second conveyor 2 is arranged in a lower portion of the tablet printing apparatus S. After the first printing unit 3 performs printing on one surface of a tablet, the second conveyor 2 conveys the tablet such that the second printing unit 4 located above it can perform printing on the other surface of the tablet.

The second conveyor 2 is of basically the same configuration as the first conveyor 1 as described above. That is, the second conveyor 2 includes a first pulley 21 as a driving source, a second pulley 22 as a driven pulley, an endless conveyor belt 23, and a suction chamber 24.

The first pulley 21 is a right pulley of the two pulleys illustrated as circles in the second conveyor 2 in FIG. 1. The second pulley 22 is a left pulley of the two pulleys illustrated in FIG. 1.

The conveyor belt 23 conveys the tablet with the rotation of the first pulley 21 and the second pulley 22. The conveyor belt 23 is provided on its surface with a pocket (recess) to hold the tablet and a suction hole for adhering the tablet to the belt surface (both not illustrated).

The suction chamber 24 applies a suction force to the suction hole of the conveyor belt 23. As the suction chamber 24 sucks in air, the tablet is sucked and held in the recess through the suction hole. Because of such a function, the suction chamber 24 is capable of applying a suction force to the suction hole at any position in the entire circumference of the conveyor belt 23.

The second conveyor 2 employs the above configuration, and both the first pulley 21 and the second pulley 22 rotate counterclockwise. Accordingly, in the second conveyor 2, the conveyor belt 23 moves in a direction indicated by the solid arrow in the upper horizontal region, i.e., leftward from the first pulley 21 toward the second pulley 22.

On the upper side of the second conveyor 2, the second printing unit 4 is arranged at a position facing the surface of the conveyor belt 23 which moves from the first pulley 21 towards the second pulley 22. Accordingly, when printing is performed on a tablet in the second printing unit 4, the tablet is placed on the conveyor belt 23 and conveyed below the second printing unit 4.

The second printing unit 4 includes an inkjet printing unit 41 that performs printing on a tablet, a position detector 42 that is located on the upstream side of an inkjet head 411 of the inkjet printing unit 41 in the moving direction of the conveyor belt 23, and a printing state checking device 43 that is located on the downstream side of the inkjet head 411 in the moving direction of the conveyor belt 23.

The position detector 42 includes an imaging device 421 for photographing a tablet and an illumination 422 for illuminating the tablet to be photographed. The printing state checking device 43 includes an imaging device 431 for photographing the printing state of the tablet and an illumination 432 for illuminating the tablet to be photographed.

The inkjet printing unit 41, the position detector 42, and the printing state checking device 43 have basically the same role and operate in the same manner as the constituent elements of the first printing unit 3 described above.

On the lower side of the conveyor 2, there is provided a drying device 25 for drying the ink of the tablet after printing. More specifically, the drying device 25 is located in a position facing a region where the conveyor belt 23 moves from the second pulley 22 to the first pulley 21 (a horizontal portion on the lower side of the conveyor 2 between the reference marks I and J in FIG. 1).

Similarly to the arrangement position of the drying device 16 described above, the drying device 25 may be arranged in any position as long as it can dry the ink printed on the tablet without interfering with other mechanisms constituting the tablet printing apparatus S.

On the downstream side of the drying device 25 in the second conveyor 2, there are provided boxes 26 and 27 for collecting the tablet having been printed on its upper and lower surfaces according to the quality of printing. Based on the checking result from the printing state checking device 33 and the printing state checking device 43, the control unit 5 determines whether printing is acceptable for each tablet.

For example, when it is determined that the printing state is appropriate, the tablet is sent as a good tablet from the conveyor belt 23 to the non-defective tablet collection box 26. On the other hand, if it is determined that the printing state is inappropriate, the tablet is sent as a defective tablet from the conveyor belt 23 to the defective tablet collection box 27. As an example of the defective tablet collection means, air may be blown against a defective tablet while the tablet is falling from the conveyor belt 23 to the non-defective tablet collection box 26 to store it in the defective tablet collection box 27.

(Printing Operation)

Next, with reference to FIG. 1, a printing operation for performing printing on a tablet using the tablet printing apparatus S will be described step by step.

First, tablets contained in the hopper 15 are supplied toward the first pulley 11 of the first conveyor 1 which rotates clockwise. The tablets supplied from the hopper 15 are sequentially stored one by one in each recess of the conveyor belt 13.

The tablets are supplied from the hopper 15 at the position as illustrated in FIG. 1. The suction chamber 14 applies a suction force to the suction hole. Thus, the tablets in the recesses are sucked and held in the recesses without falling.

The tablets are conveyed while being stored in the recesses of the conveyor belt 13 by the suction chamber 14, and a character, a letter, a figure, or the like is printed on the upper surface thereof by the first printing unit 3 located above the first conveyor 1. The character, letter, figure, or the like is set in advance.

Specifically, first, the position detector 32 checks the position of the tablet stored in each recess of the conveyor belt 13. The position of the tablet and the recess photographed by the imaging device 321 is sent to the control unit 5, and it is determined whether printing is possible.

Incidentally, if a dividing line is provided to the tablet to be printed or the tablet has a shape of triangle or quadrangle, and it is necessary to distinguish the orientation prior to printing, the orientation of the tablet may be detected in addition to the position.

When it is determined that the tablet is located in a position where printing cannot be applied and thus printing is impossible, a process in which the tablet passes under the first printing unit 3 without printing or the like is performed. On the other hand, when it is determined that the tablet is stored at a printable position and that printing is possible, the tablet is conveyed by the conveyor belt 13 to below the inkjet head 311.

The inkjet head 311 performs printing on the upper surface of the tablets conveyed. Upon completion of printing, the tablets are conveyed and moved to below the printing state checking device 33.

The printing state checking device 33 photographs the tablets and sends the captured images to the control unit 5. On the basis of the information sent from the printing state checking device 33, the control unit 5 determines whether the printing state is acceptable.

Thereafter, the tablets are reversed by the second pulley 12 while being stored in the recesses of the conveyor belt 13 and moved from the upper side to the lower side of the first conveyor 1.

The drying device 16 is arranged in a position where the conveyor belt 13 is moving leftward in FIG. 1 from the second pulley 12 to the first pulley 11. Since the printed surface of the tablet that is moving leftward faces the drying device 16, the ink on one side of the tablet is dried by the drying device 16.

Further, on the downstream side of the drying device 16, the conveyor belt 13 faces the conveyor belt 23 of the second conveyor 2. The first pulley 21 and the second pulley 22 in the second conveyor 2 are rotating counterclockwise. Accordingly, the conveyor belt 23 wound around the pulleys rotates counterclockwise. That is, the conveyor belt 23 moves leftward in the upper horizontal region in FIG. 1.

Thus, in a region where the conveyor belt 13 of the first conveyor 1 meets the conveyor belt 23 of the second conveyor 2, the both move in the same direction, i.e., to the left in FIG. 1.

The first pulley 11 of the first conveyor 1 and the first pulley 21 of the second conveyor 2 are positioned so that their axes are aligned in the vertical direction. Therefore, the tablets are transferred at a position F where the conveyor belt 13 comes in contact with the first pulley 11 of the first conveyor 1 and the conveyor belt 23 is separated from the first pulley 21 of the second conveyor 2.

However, the positional relationship between the first pulley 11 of the first conveyor 1 and the first pulley 21 of the second conveyor 2 is not limited to the one as described in the first embodiment. The positions of the two may be misaligned.

When the conveyor belt 23 is viewed from above, the tablets transferred from the first conveyor 1 to the second conveyor 2 are stored in the recesses in a state where the surface printed by the first printing unit 3 faces the bottom of the recess and the opposite surface can be viewed.

In the second conveyor 2, printing is performed on the unprinted surface of the tablet. The printing is performed in the same manner as described above. The position of the tablet is checked by the position detector 42. After printing is performed by the inkjet head 411, the printing state is checked based on the information from the printing state checking device 43.

The drying device 25 dries the ink on tablets, for which printing has been completed, in the lower horizontal region of the second conveyor 2. At this time, the surface of the tablet printed by the second printing unit 4 faces the drying device 25. The ink is dried while the conveyor belt 23 moves from the second pulley 22 toward the first pulley 21.

The dried tablets are collected to be stored in the collection boxes 26 and 27. Specifically, if the control unit 5 has determined for a tablet that printing has been appropriately performed based on the checking results from the printing state checking device 33 and the printing state checking device 43, the tablet is stored in the non-defective tablet collection box 26. On the other hand, if the control unit 5 has determined for a tablet that printing is inappropriate, the tablet is stored in the defective tablet collection box 27. In the first embodiment, a tablet which is determined not to be printed from the detection results of the position detectors 32 and 42 is also sent to the defective tablet collection box 27.

(Printing Unit)

Described below is a printing unit P according to the first embodiment. As described above, the first printing unit 3 and the second printing unit 4 constituting the printing unit P have substantially the same configuration. Therefore, only the first printing unit 3 will be described as an example.

Figure 2:
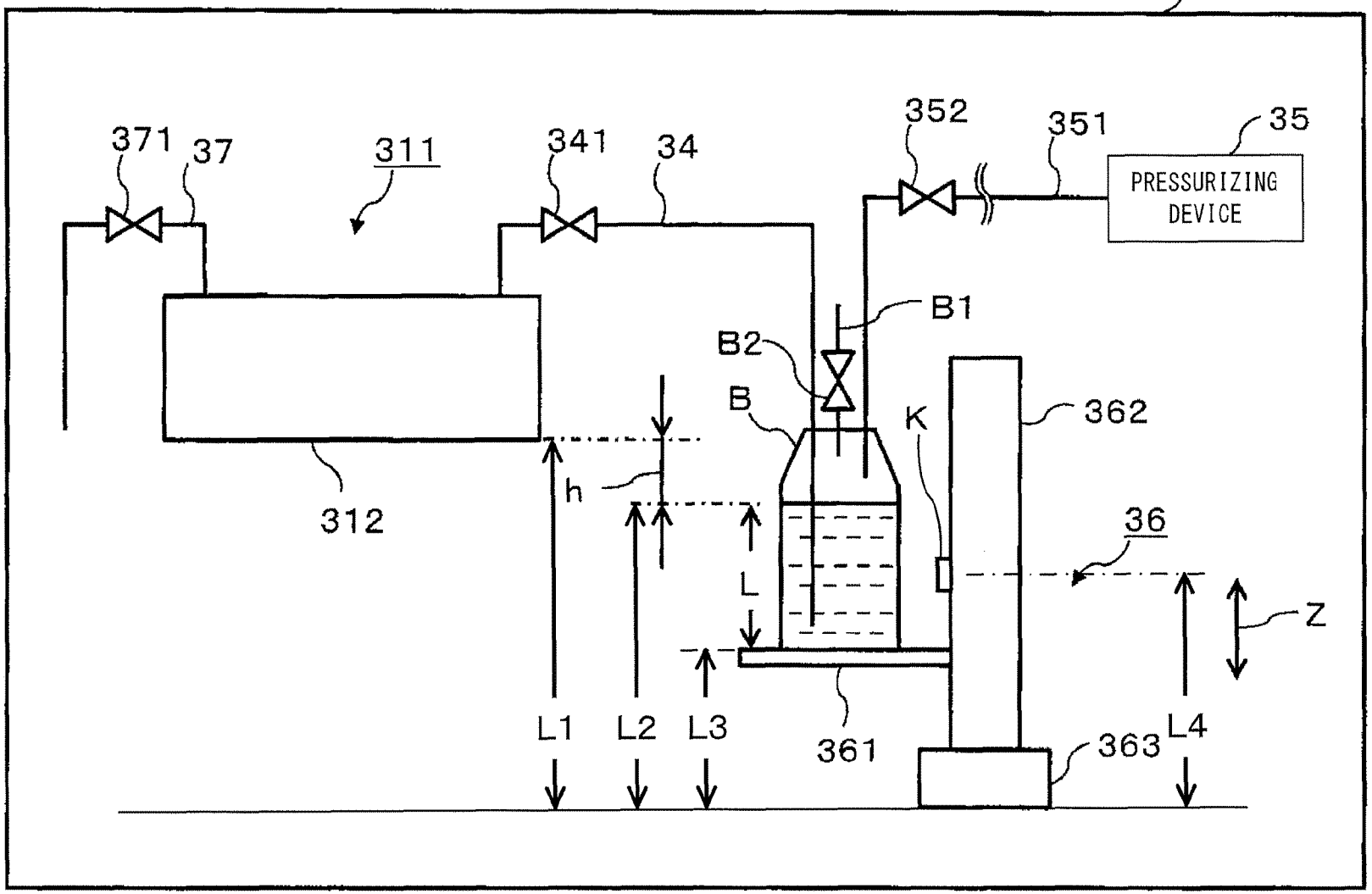
FIG. 2 is a schematic diagram illustrating a configuration of an inkjet printing unit of a first printing unit according to the first embodiment.

FIG. 2 is a schematic diagram illustrating a configuration of the inkjet printing unit 31 of the first printing unit 3 according to the first embodiment.

As illustrated in FIG. 2, the inkjet printing unit 31 includes the inkjet head 311 located to face tablets. The inkjet head 311 has a nozzle (not illustrated) to eject ink therefrom, thereby performing printing on the tablets. When maintenance such as purge or dummy ejection is performed, ink is ejected from the nozzle as well.

Note that the inkjet head 311 does not move to maintain the head difference h between the height L1 of a nozzle forming surface 312 of the inkjet head 311 and the height L2 of the liquid level of the ink in the ink tank B. Although the inkjet head 311 may be moved to adjust the ink ejection distance with respect to the tablet to be printed, the inkjet head 311 is not moved in maintaining the head difference h. Since the distance between the tablet and the inkjet head 311 does not change during printing, the distance at which ejected ink reaches the tablet is kept constant. Thereby, clear printing can be performed even on a small tablet.

The inkjet head 311 is connected to an ink supply path 34 for receiving a supply of ink from the ink tank B. That is, one end of the ink supply path 34 is connected to the inkjet head 311, and the other end is connected to the ink tank B. For example, a tube having flexibility can be suitably used for the ink supply path 34.

A valve 341 is provided in the middle of the ink supply path 34 to supply ink from the ink tank B to the inkjet head 311 or stop the supply of ink. The valve 341 may be opened and closed manually. Alternatively, the valve 341 may be opened and closed under the control of the control unit 5.

The ink tank B is a bottle for storing ink used in printing or maintenance (hereinafter collectively referred to as "printing process or the like"). The ink tank B contains, for example, an amount of ink which is used in a day's printing process or the like and can be used up without being replenished.

In the tablet printing apparatus S according to the first embodiment, printing is performed on a tablet that a person puts in the mouth. Therefore, for example, in order to prevent various foreign matters or the like from being mixed in the ink or deterioration of the ink, it is preferable to use up the ink, for example, in a day's printing process or the like. In some cases, if the ink is replenished from another tank or the like to the ink tank B, foreign matter is likely to be mixed in the ink of the ink tank B, or it becomes difficult to manage the expiration date. For this reason, it is desirable to use up the ink in the ink tank B.

Therefore, in the ink tank B of the first embodiment, for example, an amount of ink that can be used up in a day's printing process or the like, or an amount of the ink that allows for an extra amount such as an error in the amount that can be used up.

Accordingly, for example, a new ink tank B is prepared before the start of the printing process or the like, and the necessary amount of ink is used in the printing process or the like. When the day's printing process or the like is completed, even if the ink remains, the ink tank B is replaced. Note that the replaced ink tank B can be reused by cleaning it. If the cleaning is difficult, the ink tank B can be disposable.

A pipe B1 is connected to an upper part of the ink tank B, and the pipe B1 is provided with a valve B2. The pipe B1 and the valve B2 are used for exposing the inside of the ink tank B to the atmosphere.

The upper part of the ink tank B is also connected to a pipe 351 connected to a pressurizing device 35. The pressurizing device 35 is used for applying pressure to the ink in the ink tank B. A valve 352 is provided in the middle of the pipe 351 connecting the ink tank B and the pressurizing device 35. The valve 352 is opened and closed according to the pressurization process.

Incidentally, both the valves B2 and 352 may be opened or closed manually or in response to an instruction from the control unit 5 similarly to the valve 341 described above.

The ink tank B is placed on a moving device 36 for maintaining the height L2 of the liquid level of the ink in the ink tank B at a predetermined height.

The moving device 36 includes a placement table 361 on which the ink tank B is placed, a moving mechanism 362 for moving the placement table 361, and a driving device 363 for driving the moving mechanism 362.

Although not specifically illustrated in FIG. 2, there may be provided, for example, an instrument, a device, or the like for preventing the ink tank B placed on the placement table 361 from falling over or the like.

The placement table 361 moves in the Z axis direction indicated in FIG. 2 as the moving mechanism 362 is driven with the driving force from the driving device 363. As the placement table 361 moves in the Z-axis direction in this manner, the ink tank B also moves.

Various types of mechanisms, such as a ball screw, can be used as the moving mechanism 362 as long as they are capable of moving the ink tank B in the Z-axis direction.

The driving device 363 applies a driving force to the moving mechanism 362 to move the ink tank B in the Z axis direction. The driving device 363 is electrically connected to the control unit 5 illustrated in FIG. 1, and drives the moving mechanism 362 based on a control signal from the control unit 5.

In the case where the moving mechanism 362 employs a ball screw, for example, a motor or the like for rotating the ball screw can be used as the driving device 363. Any device may be used as long as it can provide a driving force sufficient for the moving mechanism 362 to move the placement table 361 (the ink tank B) in the Z axis direction.

A drain pipe 37 is connected to the inkjet head 311. A valve 371 is provided in the middle of the drain pipe 37. The valve 371 is opened and closed manually or under the control of the control unit 5.

In the first embodiment, it is premised that the ink contained in the ink tank B is used up, for example, in a day's printing process or the like. Accordingly, the ink remaining in the inkjet head 311 is not returned to the ink tank B, and when the printing process or the like is completed, the ink in the inkjet head 311 is drained from the drain pipe 37.

As described above, the ink tank B contains the ink used in the printing process or the like. In the printing process or the like, the ink is supplied from the ink tank B to the inkjet head 311 through the ink supply path 34 so that the ink can be ejected from the inkjet head 311. Thereafter, in order to prevent ink leakage from the nozzle of the inkjet head 311, the head difference h needs to be maintained at a predetermined value (predetermined head difference).

(Head Difference)

The head difference h is intended to generate a negative pressure in the inkjet head 311. The head difference h is a difference between the height L1 of the nozzle forming surface 312 where a nozzle (not illustrated) of the inkjet head 311 is formed and the height L2 of the liquid level of the ink in the ink tank B. Generally, in the printing process or the like, the head difference h is set such that the height L2 of the ink liquid level in the ink tank B is slightly lower with respect to the height L1 of the nozzle forming surface 312 of the inkjet head 311. Therefore, in FIG. 2, the height L2 of the ink liquid level is illustrated to be lower than the height L1 of the nozzle forming surface 312.

The height L2 of the liquid level of the ink in the ink tank B (hereinafter referred to as "height L2 of the ink level") is the sum of the height L3 from the reference surface to the bottom surface of the ink tank B and the height L from the bottom surface of the ink tank B to the liquid level of the ink in the tank B (hereinafter referred to as "ink height L"). The reference surface is, for example, the upper surface of a common base such as a base plate in the first printing unit 3. The driving device 363 and the like are placed on the upper surface.

During the printing process, if the head difference h varies significantly, the amount of ink ejected from the nozzle also varies significantly. When printing is performed on a tablet in the tablet printing apparatus S, the amount of ink used for printing is very small. Therefore, if there is a large change in the amount of ink ejected, blur or ink bleeding occurs in printing. As a result, printing on the tablet is not performed properly. For this reason, at least during the printing process, it is necessary to maintain the head difference h at a predetermined value to thereby stabilize the amount of ink ejected.

The predetermined value of the head difference h is determined within a predetermined acceptable range having a range of the head difference suitable for printing on the tablet. Specifically, the head difference h, i.e., the difference between the height L1 of the nozzle forming surface 312 of the inkjet head 311 and the height L2 of the ink level in the ink tank B, is set within a predetermined acceptable range having a certain degree of extent such as, for example, between −5 mm and +5 mm. The head difference h acceptable for use in the printing process or the like and the range thereof vary depending on the flow path structure and shape in the inkjet head 311, the sectional shape and hole diameter of the nozzle, the characteristics of the ink used such as viscosity and specific gravity, and the like, and therefore are determined by experiment ore the like.

(How to Maintain the Head Difference During the Printing Process)

In the following, a description will be given of how to maintain the head difference h at a predetermined value during the printing process or the like with reference to drawings.

Figure 3:
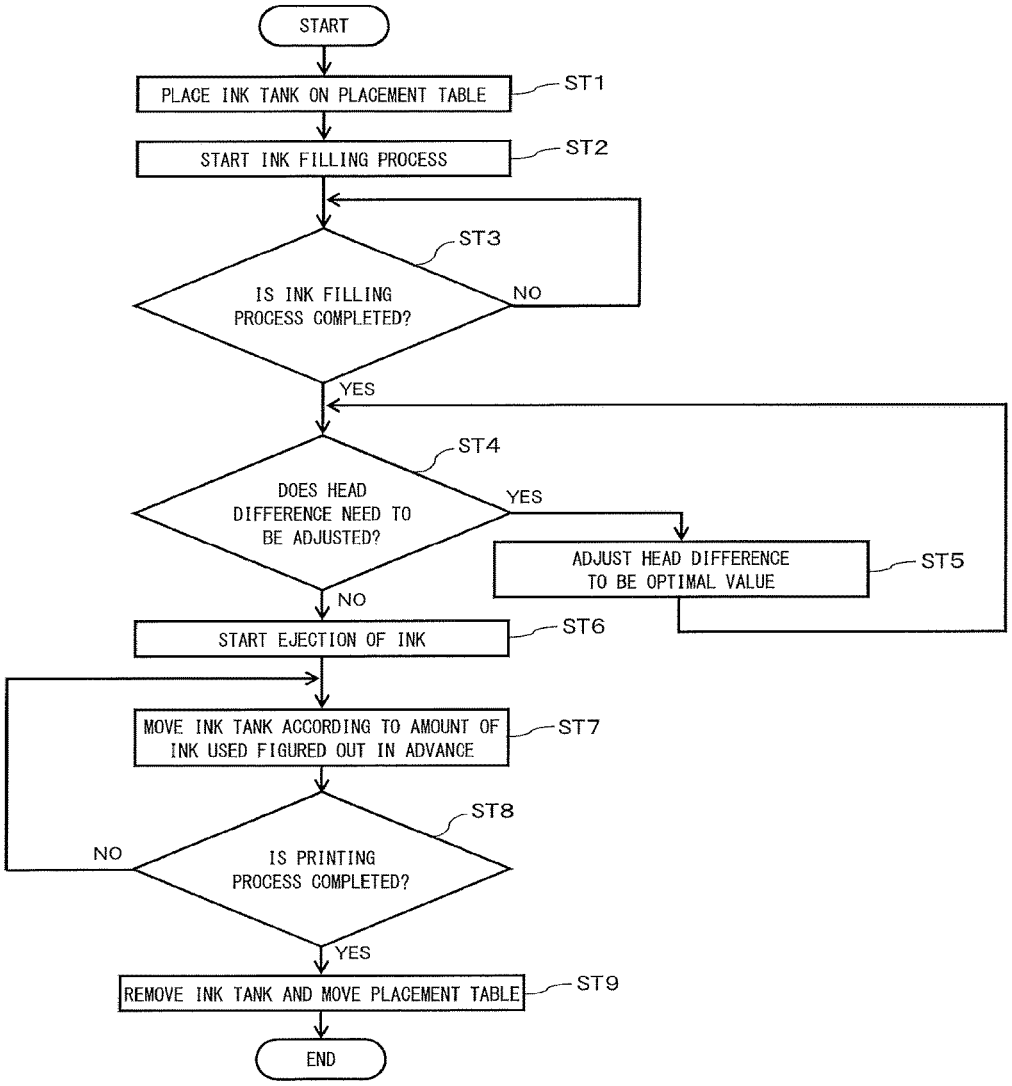
FIG. 3 is a flowchart illustrating a flow of tablet printing according to the first embodiment.

FIG. 3 is a flowchart illustrating a flow of tablet printing according to the first embodiment. FIG. 3 illustrates, for example, a flow of the printing process or the like on tablets in one day.

As illustrated in FIG. 3, first, the ink tank B is placed on the placement table 361 (ST1) at the start of the printing process or the like. As the type of the ink tank B varies, an appropriate ink tank (B) is selected according to tablets to be printed and print contents, and placed.

One end of the ink supply path 34 is connected to the ink tank B placed on the placement table 361 so that ink can be supplied to the inkjet head 311. One end of the pipe 351 connected to the pressurizing device 35 is also connected to the upper part of the ink tank B. Further, the pipe B1 having the valve B2 is also connected to the upper part of the ink tank B.

When the ink tank B is ready, the inkjet head 311 is filled with ink (ST2). In the filling process, first, the valve 352, which is provided in the pipe 351 that connects the pressurizing device 35 and the ink tank B, and the valve 341, which is provided in the ink supply path 34 that connects the ink tank B and the inkjet head 311, are opened. In addition, the valve 371 provided in the drain pipe 37 is also opened. Thereupon, the pressurizing device 35 is used to apply pressure to the ink in the ink tank B.

In response to this pressure application, the ink in the ink tank B is filled in the inkjet head 311 through the ink supply path 34. When the inkjet head 311 is filled with the ink, the ink overflowing from the inside of the inkjet head 311 after that is drained to the outside of the inkjet head 311 through the drain pipe 37.

During the filling process, the control unit 5 checks as to whether the inkjet head 311 is filled with the ink, i.e., whether the ink filling process is completed (ST3). When the ink reaches the drain pipe 37, it indicates that a flow path (not illustrated) in the inkjet head 311 is filled with the ink, and it can be determined that the filling process is completed. Therefore, for example, it may be determined that the filling process has ended by detecting whether the ink is present in the drain pipe 37 with a sensor (not illustrated) provided in the drain pipe 37 or by detecting the drainage of the ink from the drain pipe 37 (YES in ST3). When it is determined that the filling operation is completed, the valve 371 of the drain pipe 37 is closed.

Next, the control unit 5 checks whether it is necessary to adjust the height L2 of the ink level in the ink tank B (ST4).

Here, as illustrated in FIG. 2, a sensor K is installed in the moving path of the placement table 361 of the moving mechanism 362. The sensor K is used for detecting the height L2 of the ink level in the ink tank B. Therefore, the sensor K is only required to be able to detect the liquid level, and may be provided in a place other than the moving mechanism 362. A height L4 at which the sensor K detects the liquid level is set below a height at which the height L2 of the ink level in the ink tank B is a predetermined value.

The control unit 5 checks whether the liquid level in the ink tank B is detected by the sensor K upon completion of the filling process. When the liquid level is not detected by the sensor K (YES in ST4), the control unit 5 controls the placement table 361 to move upward or downward in the Z direction until it is detected. For example, when the liquid level is not detected even if the placement table 361 is raised for a preset distance or time, the placement table 361 is lowered. When the sensor K detects the liquid level, the control unit 5 stops the placement table 361. At this time, the height L4 at which the sensor K is installed (liquid level detection height) becomes the height L2 of the ink level in the ink tank B. That is, it is possible to calculate the difference between a predetermined value (predetermined head difference) and the height L2 of the current ink level. The control unit 5 drives the placement table 361 so that the difference becomes zero. As a result, the height L2 of the ink level in the ink tank B is adjusted to a height at which the head difference h becomes the predetermined value (ST5).

As described above, when the filling process is completed, the valve 371 of the drain pipe 37 is closed. In order to start the ejection of the ink from the inkjet head 311, the valve 352 provided in the pipe 351 connecting the pressurizing device 35 and the ink tank B is also closed. On the other hand, the valve B2, which is provided in the upper part of the ink tank B and closed in the filling process, is opened. Thereby, the inside of the inkjet head 311 is exposed to the atmosphere. In this state, the valve 341 provided in the ink supply path 34 which connects the ink tank B and the inkjet head 311 is open. Thus, the ink is supplied from the ink tank B to the inkjet head 311, and the ink is ejected.

Note that it is better not to perform the exposure to the atmosphere upon completion of the filling process. Even if the ink level in the ink tank B drops excessively by continuing to pressurize the inside of the ink tank B, it is possible to suppress the ink from returning from the inkjet head 311 to the ink tank B.

With respect to the ink consumption amount, it is possible to previously figure out the amount of ink to be consumed in, for example, a day's printing process or the like. For example, the number of tablets to be printed in the day's printing process or the like is determined in advance. From the print contents on the tablet, the amount of ink applied to one tablet is also determined in advance. With reference to these pieces of information, for example, the amount of ink consumed by the day's printing process or the like is figured out. On the basis of this, it is possible to figure out the amount of ink consumed per the number of prints of tablets or per unit time of the printing process.

The amount of ink consumed per the number of prints of tablets or per unit time is the amount of ink consumed from the inside of the ink tank B. The inner diameter of the ink tank B can also be figured out in advance. Thus, it is possible to grasp changes in the ink height L in the ink tank B per the number of prints and unit time. Accordingly, it is possible to figure out changes in the head difference h per the number of prints and unit time.

Figure 4:
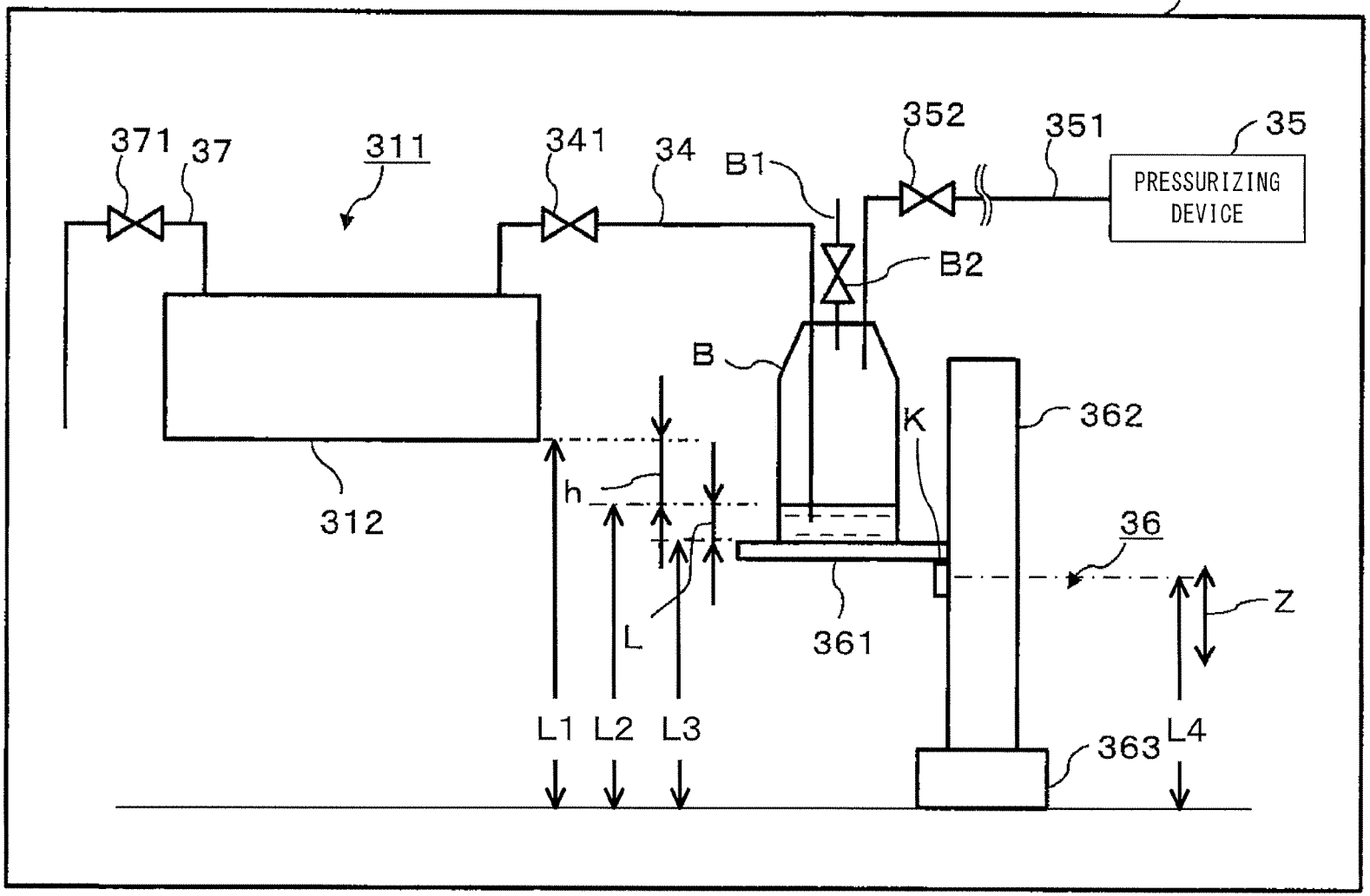
FIG. 4 is a schematic diagram for explaining the movement of an ink tank illustrated in FIG. 2.

FIG. 4 is a diagram illustrating a state where the ink is consumed in the ink tank B illustrated in FIG. 2 and the ink tank B is raised. Because of this, the height L3 of the ink tank B is different from that in FIG. 2 used for describing the configuration of the first printing unit 3.

As described in step ST1 of FIG. 3, FIG. 2 illustrates a state where a new ink tank B is placed on the placement table 361. Accordingly, the ink tank B contains sufficient ink, and the height L3 of the ink tank B is set such that the head difference h becomes a predetermined value according to the height L2 of the ink level.

On the other hand, FIG. 4 illustrates a state where the printing process or the like proceeds, and the ink in the ink tank B has been consumed by the ejection of the ink from the nozzle, resulting in that the ink height L in the ink tank B has been lowered. FIG. 4 also illustrates a state where the ink tank B is moved upward by using the moving device 36 to locate the ink level in the ink tank B lowered so that the head difference h becomes a predetermined value. In other words, FIG. 4 illustrates that the head difference h is kept at a predetermined value even if the printing process proceeds and the ink is consumed.

As illustrated in step ST7 in FIG. 3, it is possible to predict the state of the liquid level drop in the ink tank B in terms of the number of prints or the unit time based on the amount of ink used in the printing process or the like previously figured out. By moving the ink tank B itself upward according to the predicted state of the liquid level drop, the change of the ink height L, i.e., the height L2 of the ink level is canceled, and the head difference h is kept at a predetermined value.

By previously figuring out the change of the ink height L in the ink tank B in this manner, the height L2 of the ink level in the ink tank B can be changed so as to maintain the head difference h at a predetermined value in response to the ink consumption due to the printing process or the like and the gradual lowering of the liquid level in the ink tank B. For example, control is performed so as to move the placement table 361 upward by the above-described amount of change of the ink height L in the ink tank B for every predetermined number of tablets or every predetermined unit time.

After step ST5 described above, when the nozzles of the inkjet head 311 starts ejecting the ink in the printing process or the like, the control unit 5 controls the driving device 363 of the moving device 36 to move the ink tank B upward according to the amount of ink used which is figured out in advance (ST7).

At this time, the amount of ink to be consumed is figured out in advance. Thus, even if the amount of ink contained in the ink tank B is reduced due to the use of the ink in the printing process or the like and the ink height L is lowered, based on the information on the amount of the ink to be consumed, the ink tank B is controlled to move upward using the moving device 36 so that the height L3 of the ink tank B is increased according to the change. With this, even if the ink in the ink tank B is used in the printing process or the like and the ink height L is lowered, the head difference h can always be maintained at a predetermined value.

The control unit 5 determines as to whether the printing process or the like is completed at any time (ST8). For example, the control unit 5 determines that the printing process or the like is completed when the supply of tablets from the hopper 15 ends, or when the operator presses an operation button. The control unit 5 instructs the moving device 36 to stop moving the ink tank B upon completion of the printing process or the like on the tablets by the tablet printing apparatus S.

When the printing process or the like is completed, the ink tank B used is removed from the placement table 361. The placement table 361 is moved downward again in preparation for the placement of the next ink tank B (ST9). With respect to the downward movement of the placement table 361, the control unit 5 takes into consideration the ink height L (head difference h) in the ink tank B that contains the ink to be used next, and informs the driving device 363 of the move distance.

If the predetermined acceptable range of the head difference h is larger than the detection accuracy (e.g., −2 mm to +2 mm) of the sensor K such as, for example, from −5 mm to +5 mm, the initial position of the liquid level falls within the acceptable range. However, when the predetermined acceptable range of the head difference h is smaller than the detection accuracy (e.g., −2 mm to +2 mm) of the sensor K such as, for example, from −1 mm to +1 mm, it is not known whether the initial position is within the predetermined acceptable range (1). In addition, the timing of turning the sensor K OFF (out of the predetermined acceptable range) is inaccurate (2). Further, the value at which the sensor K turns ON again is also inaccurate (3).

For this reason, control is performed with errors due to sensor accuracy. Generally, the sensor has a hysteresis. For example, in the case of raising the liquid level because the liquid level, which has been detected, cannot be detected, the detection result (height) is often different between when the liquid level, which has been detected, cannot be detected (ON to OFF) and when the liquid level, which has not been detected, is detected (OFF to ON).

Regarding the problems (2) and (3) above, detection error can be reduced by detecting the liquid level at the initial position so as to bring a specific state, i.e., a state where the liquid level which has not been detected is detected. Therefore, with respect to the liquid level detection of the sensor K, if the detection is performed with error only in the case that the ink level which has not been detected by the sensor K is detected, i.e., only in the case that the sensor K is turned from OFF to ON, the error due to the hysteresis of the sensor K can be cancelled.

Further, if the detection accuracy of the sensor K when the sensor K turns from OFF to ON is figured out in advance, the liquid level can be positioned in consideration of the accuracy. As described above, the height L4 at which the sensor K detects the liquid level is set below the height at which the height L2 of the ink level in the ink tank B is a predetermined value. Therefore, the ink tank B is necessarily moved a certain distance from the height (L4) at which the liquid level is detected by the sensor K such that the liquid level of the ink is positioned to a height at which the head difference h becomes a predetermined value. That is, as described above, if the detection error of the sensor K in a specific state is figured out in advance by experiment or the like, and the liquid level is positioned by moving the ink tank B upward in anticipation of this detection error, it is possible to solve the problem (1). As a result, the initial position of the liquid level can be set within a predetermined acceptable range.

As described above, on the basis of the information about the amount of ink consumed per the number of prints or unit time which are figured out in advance, control is performed such that the height L3 of the ink tank B gradually changes to keep the height L2 of the ink level in the ink tank B, i.e., the head difference h, at a predetermined value. This makes it possible to stabilize the amount of ink ejected from the inkjet head 311 and perform printing on tablets in a satisfactory manner.

Although the sensor K for detecting the ink height L in the ink tank B is used to adjust the head difference h to a predetermined value before the start of the printing process or the like, there is no need of a sensor that always detects a change in the amount of ink in the ink tank B. Thus, the tablet printing apparatus S can have a simpler configuration. That is, it suffices if the height L2 of the initial ink liquid level (initial position) can be set within a predetermined acceptable range, and this may be visually checked without using a sensor.

Incidentally, the amount of ink used for purge, dummy ejection in periodic maintenance, and the like can also be figured out. This amount may be added to the ink consumption amount. With this, even when maintenance is performed, the head difference h can be adjusted to a predetermined value at the start of printing thereafter.

More specifically, maintenance, such as purge and dummy ejection, is performed in the inkjet head 311. Also in the maintenance, ink is ejected from the nozzle. The amount of ink consumed in such a maintenance process can also be figured out in advance. Therefore, for example, with respect to the amount of ink ejected in a day's printing process or the like, each piece of information, such as the number of tablets to be printed, the amount of ink ejected for each tablet, and the amount of ink ejected in the maintenance process, may be added to the ink consumption amount.

In particular, purge in the maintenance process consumes more ink compared to printing or dummy ejection. Therefore, when the purge is performed, a consumption amount different from that of other cases is set. By changing the height of the ink tank B based on this different consumption amount, the head difference h can be maintained at a predetermined value even immediately after the purge. Besides, even after maintenance performed at a predetermined timing, the head difference h can be maintained at a predetermined value. Further, even if tablets are conveyed randomly without being aligned in the conveyance direction and the amount of ink consumed within a unit time fluctuates, this can be dealt with.

As described above, according to the first embodiment, it is possible to grasp the ink consumption amount per the number of prints and unit time by figuring out the amount of ink to be used beforehand. Accordingly, by adjusting the height of the ink tank B based on the consumption amount, it is possible to maintain the head difference h between the height L1 of the nozzle forming surface 312 of the inkjet head 311 and the height L2 of the ink level in the ink tank B at a predetermined value. This makes it possible to stabilize the amount of ink ejected from the inkjet head 311 and perform printing on tablets in a satisfactory manner. Thus, it is possible to provide a tablet printing apparatus (S) and a tablet printing method capable of appropriate printing on a small printing object such as a tablet.

When printing is applied to a small tablet, a slight change in the head difference h causes a large change in the amount of ink ejected. In the first embodiment, the head difference h can be maintained at a predetermined value in almost real time. Therefore, there is no large change in the amount of ink ejected. Thus, printing can be appropriately applied to tablets without blurring or bleeding of the print.

In the first embodiment, the inkjet head 311 is not moved to maintain the head difference h. That is, the inkjet head 311 is fixed during printing on tablets. Accordingly, the interval between the tablets and the inkjet head 311 is set optimal for the printing, and the interval does not change. Thus, the distance at which ejected ink reaches the tablet is kept constant. Thereby, clear printing can be performed even on a small tablet.

An example has been described in which the filling process is performed by using the pressurizing device 35; however, the filling process may be performed by, for example, moving the ink tank B upward such that at least the liquid level in the ink tank B becomes higher than the nozzle forming surface 312. Naturally, purge can also be performed with these methods.

(First Modification)

Figure 5:
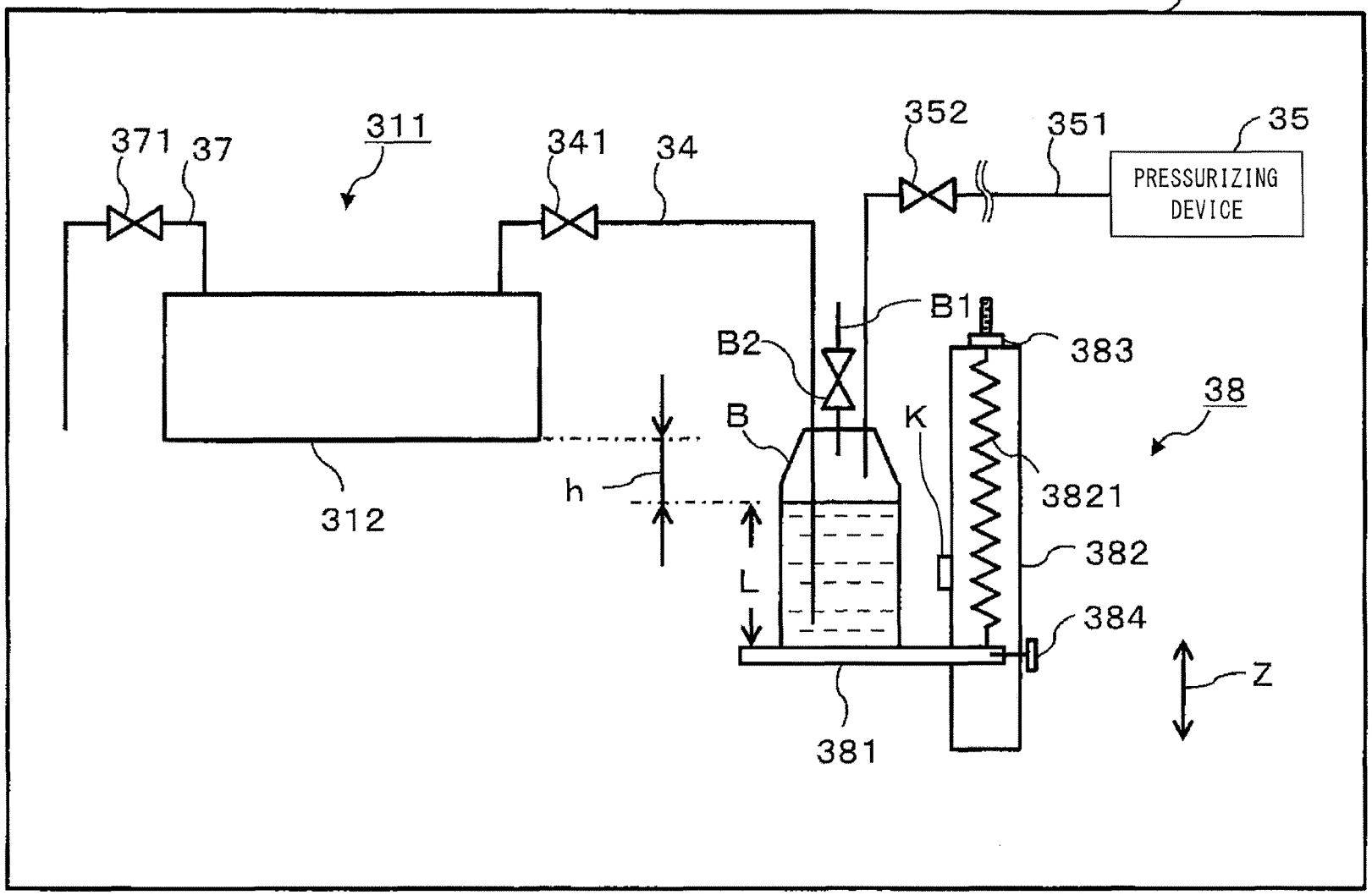
FIG. 5 is a schematic diagram illustrating another configuration of the inkjet printing unit of the first printing unit of the first embodiment (first modification).

Next, a first modification of the first embodiment will be described with reference to FIG. 5. FIG. 5 is a schematic diagram illustrating another configuration of the inkjet printing unit 31 of the first printing unit 3 of the first embodiment. The first modification is different from the first embodiment in the configuration of the moving device 36 described above. Other configurations are similar to those of the first embodiment illustrated in FIG. 2. The following description will be given using the configurations and a detailed description of each part will not be repeated.

As illustrated in FIG. 5, when the ink tank B on a placement table 381 is moved upward according to the consumption amount of ink figured out in advance, a moving device 38 of the first modification uses a spring 3821 supported on the placement table 381 as a moving mechanism 382 instead of using a driving force of a motor or the like.

The moving device 38 includes the placement table 381 for placing the ink tank B, the spring 3821 for moving the ink tank B by supporting the placement table 381, an adjusting mechanism 383 for adjusting the length of the spring 3821, and a fixing device 384 for fixing the placement table 381.

One end of the spring 3821 is connected to and supported by the placement table 381, and the other end is connected to the adjusting mechanism 383 arranged at an upper part of the moving mechanism 382. Accordingly, when the ink tank B is placed on the placement table 381, the placement table 381 is pushed downward by the weight of the ink tank B, and thereby the spring 3821 is expanded. As the weight of the ink tank B decreases along with the consumption of ink in the printing process or the like, the expanded spring 3821 is gradually compressed.

The spring constant of the spring 3821 is determined based on the use amount of ink figured out in advance. Therefore, as the ink height L in the ink tank B is gradually lowered along with the consumption of ink in the printing process or the like, the weight of the ink tank B decreases, resulting in the upward movement of the ink tank B.

That is, since the amount of ink to be used in the printing process or the like is figured out in advance, it is possible to predict the state of the liquid level drop in the ink tank B in terms of the number of prints or the unit time based on the use amount. Thus, by using the spring 3821 having a spring constant that can raise the placement table 381 by the amount corresponding to the predicted state of the liquid level drop, the ink tank B can be moved upward as the ink height L in the ink tank B is lowered.

By changing the height of the ink tank B in this manner, the change of the ink height L caused by the consumption of ink is canceled out, and the head difference h is maintained at a predetermined value. Incidentally, the spring constant is previously determined experimentally in consideration of the weight of the placement table 381, the weight of the ink tank B containing ink, and the like.

The adjusting mechanism 383 is configured to adjust the support position in the height direction of the spring to thereby adjust the position of the ink height L in the ink tank B when the ink tank B containing ink is set on the placement table 381. The adjusting mechanism 383 includes, for example, a male screw connected to the spring 3821 and a female screw (rotating at a fixed position) which meshes with the male screw.

The fixing device 384 is provided to the moving mechanism 382 and fixes the placement table 381 at a set position (height). The fixing device 384 is mainly used for removing the used ink tank B and placing a new ink tank B on the placement table 381. For example, the fixing device 384 is configured to fix the placement table 381 by making a pin pass through the placement table 381. The configuration is not limited to this, and any configuration may be adopted as long as the placement table 381 can be fixed.

Since the placement table 381 is fixed in advance by the fixing device 384, the spring 3821 does not expand and contract when the ink tank B is replaced. This facilitates the placement of the ink tank B on the placement table 381.

Note that the fixed position by the fixing device 384 may be set appropriately. For example, the fixed position may be set to a height where the operator can easily work, or may be in the vicinity of the height of the used ink tank B or in the vicinity of the height corresponding to the weight of a new ink tank B that replaces the old one.

As described above, according to the first modification, it is possible to grasp the ink consumption amount per the number of prints and unit time by figuring out the amount of ink to be used beforehand. Accordingly, by adjusting the height of the ink tank B with the spring 3821 manufactured to have a spring constant set based on the consumption amount, it is possible to maintain the head difference h between the height L1 of the nozzle forming surface 312 of the inkjet head 311 and the height L2 of the ink level in the ink tank B at a predetermined value. This makes it possible to stabilize the amount of ink ejected from the inkjet head 311 and perform printing on tablets in a satisfactory manner. Thus, it is possible to provide a tablet printing apparatus S and a tablet printing method capable of appropriate printing on a small printing object such as a tablet.

In addition, the ink tank B can be autonomously moved by the spring 3821 along with the consumption of ink. Thereby, the device configuration can be simplified without a need of a drive mechanism.

Further, as described above, there are advantages such as that a sensor is not required for detecting the upper limit and lower limit of the ink level in the ink tank B, that the head difference h can be kept at a predetermined value in almost real time, and that the inkjet head is fixed during printing on tablets.

In the first modification, an example has been described in which the spring 3821 is used to suspend the ink tank B; however, the usage of the spring is not limited to this. For example, the spring may be used to push up the ink tank B from beneath.

(Second Modification)

Next, a second modification of the first embodiment will be described with reference to FIG. 6. The second modification is different from the first embodiment in the configuration of the ink tank. Other configurations are similar to those of the first embodiment illustrated in FIG. 2. The following description will be given using the configurations and a detailed description of each part will not be repeated.

Figure 6:
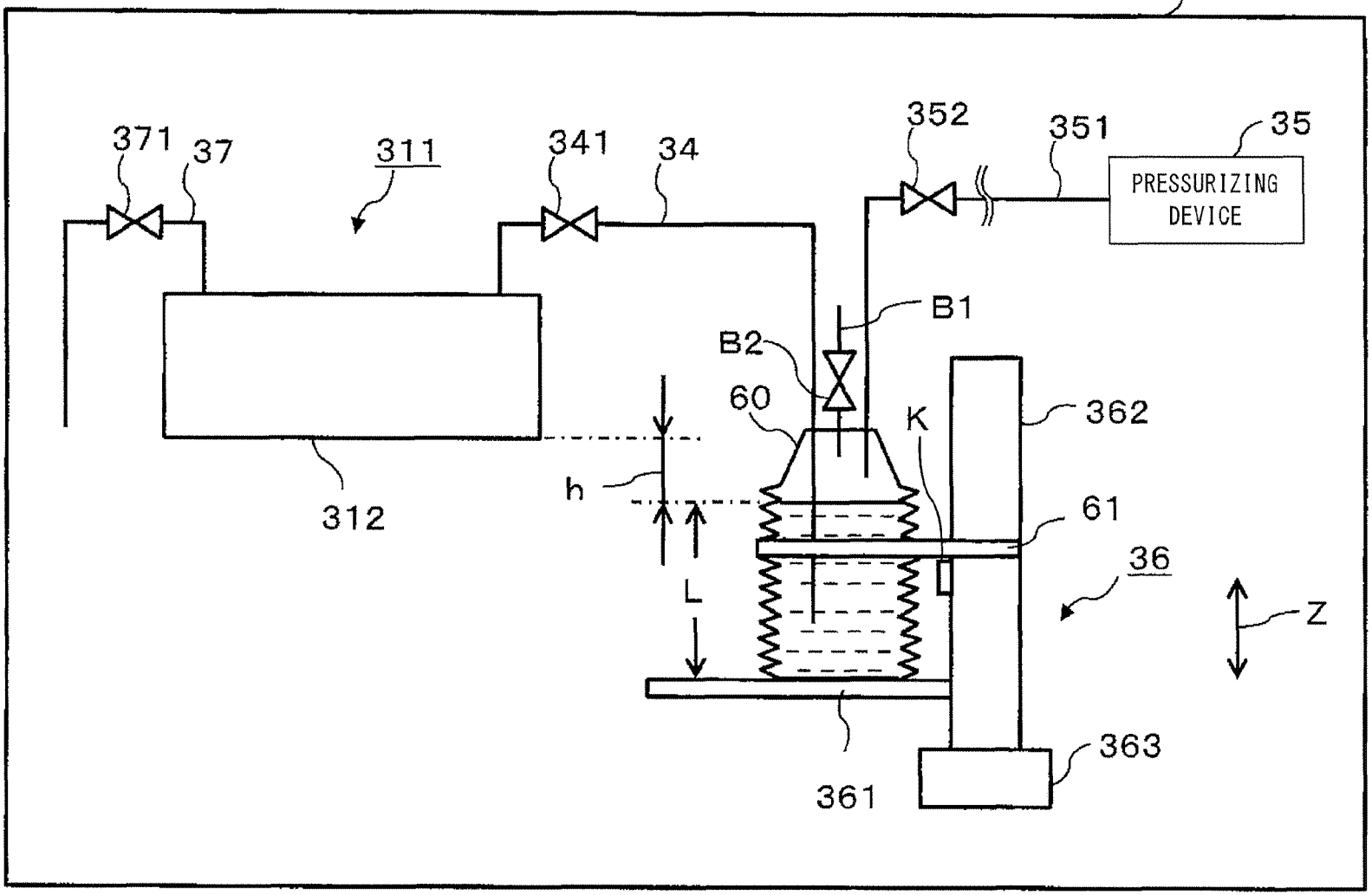
FIG. 6 is a schematic diagram illustrating still another configuration of the inkjet printing unit of the first printing unit of the first embodiment (second modification).

As illustrated in FIG. 6, an ink tank 60 is formed in a cylindrical shape, and the trunk portion thereof is formed in a bellows shape. The bellows-shaped trunk portion of the ink tank 60 is held by a fixture 61 fixed to the moving mechanism 362 of the moving device 36. The bottom portion of the ink tank 60 is placed on the placement table 361 of the moving device 36 that moves up and down in the Z direction. Accordingly, the ink tank 60 is configured to be expandable and contractible in the vertical direction at the bellows portion between the bottom portion and the trunk portion held by the fixture 61.

With this configuration, the change of the ink height L in the ink tank 60 is canceled out as described below, and the head difference h is maintained at a predetermined value. That is, as the printing process or the like progresses, the ink in the ink tank 60 is consumed by the ejection of ink from the nozzle, and the ink height L in the ink tank 60 is lowered. The change (decrease) in the ink height L is previously figured out as described above. On the basis of the change of the ink height L figured out in advance, the placement table 361 of the moving device 36 moves upward in the Z direction to maintain the ink height L in the ink tank 60. When the placement table 361 moves upward, only the bottom portion moves upward together with the placement table 361 while the height position of the trunk portion held by the fixture 61 of the ink tank 60 is maintained. Thereby, an upward pressure is applied to the ink tank 60 placed on the placement table 361. The bellows portion between the trunk portion and the bottom portion of the ink tank 60 held by the fixture 61 is compressed by the pressure received from the bottom portion. As a result, the bottom portion of the ink tank 60 rises, and the liquid level in the ink tank 60 is pushed up. Thus, the change of the ink height L is canceled out, and the ink height L is maintained.

In this manner, according to the second modification, the head difference h can be maintained at a predetermined value. This makes it possible to stabilize the amount of ink ejected from the inkjet head 311 and perform printing on tablets in a satisfactory manner. Thus, it is possible to perform appropriate printing on a small printing object such as a tablet. Besides, the head difference h can be maintained at a predetermined value by a simple configuration. Further, space saving can be realized due to a small moving range.

(Second Modification-1)

In the second modification described above, the ink tank 60 having a bellows-like trunk portion is used. However, the ink tank does not necessarily have this shape, and may be formed of an elastic member or a flexible member such that the change of the height L may be canceled out by using the elasticity or flexibility. Besides, an example has been described in which the ink tank 60 is compressed by the vertical movement of the placement table 361 of the moving device 36; however, instead of deforming the ink tank 60 by vertical compression, a pair of rollers sandwiching the ink tank 60 from both sides may be used so that the change of the ink height L can be canceled out by the movement of the rollers.

(Third Modification)

Next, a third modification of the first embodiment will be described with reference to FIG. 7. The third modification is different from the first embodiment in the configuration of the moving device for the ink tank. Other configurations are similar to those of the first embodiment illustrated in FIG. 2. The following description will be given using the configurations and a detailed description of each part will not be repeated.

Figure 7:
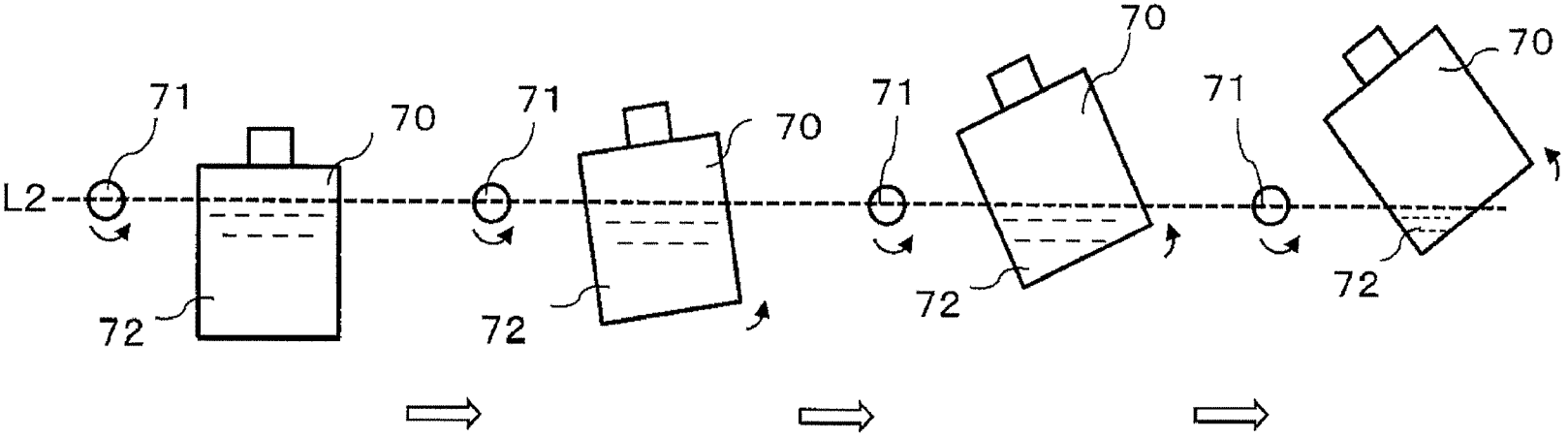
FIG. 7 is a schematic diagram for explaining another configuration of the ink tank and the operation according to the first embodiment (third modification).

FIG. 7 illustrates the operation of an ink tank 70, and illustrates a state where its inclination changes from left to right in the figure. The ink tank 70 is not moved upward to maintain the height L2 of the ink level differently from the ink tank B described in the first embodiment, but is configured to rotate so as to maintain the height L2 of the ink level.

As illustrated in FIG. 7, the moving device of the ink tank 70 has a rotation shaft 71 that rotates according to a change in the height L2 of the ink liquid level in the ink tank 70. The rotation shaft 71 is located in a position at the height L2 of the ink level when the ink tank 70 contains a predetermined amount of ink 72. The rotation shaft 71 is connected to a holder (not illustrated) configured to be rotatable along with the rotation of the rotation shaft 71, and the ink tank 70 is placed on the holder. The ink tank 70 is tilted by rotating about the rotation shaft 71, and, when the ink tank 70 contains the ink 72, the height L2 of the ink level is maintained.

The leftmost state in FIG. 7 illustrates an initial state where the ink tank 70 contains a predetermined amount of the ink 72. As the printing process or the like proceeds and the ink is used by the ejection of the ink 72 from the nozzle, the amount of the ink 72 in the ink tank 70 decreases. As described above, the ink consumption amount in the ink tank 70 is figured out in advance. Therefore, the rotation shaft 71 rotates counterclockwise according to the decrease of the ink 72 in the ink tank 70. As the rotation shaft 71 rotates, the ink tank 70 gradually tilts as illustrated from the left to the right in the figure to keep the height L2 of the ink level of the ink 72 constant at all times.

In this way, according to the third modification, the head difference h between the height L1 of the nozzle forming surface 312 of the inkjet head 311 and the height L2 of the ink level in the ink tank 60 is maintained at a predetermined value. This makes it possible to stabilize the amount of ink ejected from the inkjet head 311 and perform printing on tablets in a satisfactory manner. Thus, it is possible to perform appropriate printing on a small printing object such as a tablet.

Further, since the ink tank 70 rotates as described above, the tilt angle of the ink tank 70 varies according to the consumption of the ink 72. Accordingly, the operator can easily and visually check the consumption state of the ink 72. With the vertical movement as in the first embodiment, the movement is very small, and depending on the shape of the ink tank B, it is difficult to grasp the amount of ink consumption visually. According to the third modification, the ink tank 70 is rotated to be tilted. With this, the arrangement change of the ink tank 70 corresponding to the consumption amount of the ink 72 is enlarged. Thus, the consumption amount of the ink 72 can be easily observed.

Further, since only the ink tank 70 is rotated, mechanisms including a drive shaft such as a ball screw and a guide for vertical movement can be simplified. Thus, the moving mechanism can be compact compared to the one for vertical movement, resulting in less apparatus cost. Further, because of the simple mechanism, the occurrence rate of failure can be reduced.

(Third Modification-1)

Depending on the configuration of the apparatus, the rotation radius of the ink tank 70 can be set appropriately. For example, if the ink tank 70 cannot be rotated largely due to the arrangement of each constituent unit in the apparatus, the rotation center is separated from the ink tank 70 to increase the rotation radius. Thereby, the rotation amount can be reduced. Besides, in the case where a space in the vertical direction in FIG. 7 can be prepared, but a space in the horizontal direction cannot be prepared sufficiently, the rotation center is brought close to the ink tank 70 to reduce the rotation radius, making it more compact. Besides, the angle at which the ink tank 70 is rotated is increased correspondingly to the use amount of the ink 72. This facilitates the drive control for the rotation and the control of the liquid level. Since a change in the tilt angle of the ink tank 70 becomes large, the consumption state of the ink 72 can be checked more easily. In this way, the rotation radius of the ink tank 70 can be determined appropriately in consideration of the arrangement of the apparatus in terms of configuration, the ease of checking the use amount of the ink 72, the controllability of the liquid level, and the like.

(Third Modification-2)

It is more preferable that one end of the supply path for supplying the ink 72 to the inkjet head 311 is arranged to be positioned on the side of the ink tank 70 to which the ink 72 is moved by the rotation of the ink tank 70. With this, even when the amount of the ink in the ink tank 70 becomes extremely small, the ink 72 can be supplied to the inkjet head 311. Thus, the ink 72 can be used without waste.

Second Embodiment

In the following, a second embodiment will be described. In the second embodiment, like reference numerals designate like constituent elements as those described in the first embodiment, and the same description of the constituent elements will not be repeated.

In the first embodiment, an example of the printing unit is described in which, when the amount of ink in the ink tank B decreases and the liquid level is lowered, the position of the ink tank B is moved upward according to the decrease based on the consumption amount of ink figured out in advance. Thus, the decrease of the liquid level is canceled by changing the height L3 of the ink tank B itself, thereby keeping the head difference h at a predetermined value.

In the second embodiment, instead of adjusting the height L3 of the ink tank B, a predetermined amount of ink, which is set based on the consumption amount of ink figured out in advance, is supplied to the ink tank B to maintain the head difference h at a predetermined value.

Figure 8:
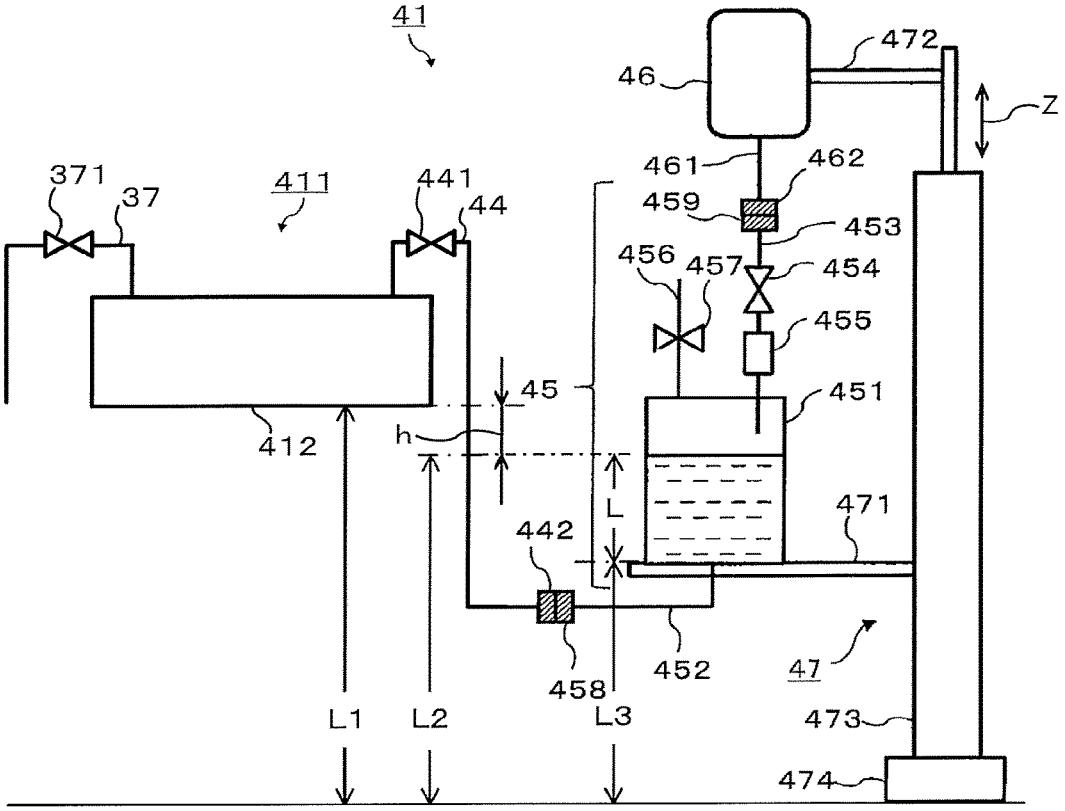
FIG. 8 is a schematic diagram illustrating a configuration of an inkjet printing unit of a second printing unit according to a second embodiment.

FIG. 8 is a schematic diagram illustrating a configuration of the inkjet printing unit of the second printing unit according to the second embodiment. In the second embodiment, a description will be given by taking the second printing unit 4 constituting the printing unit P as an example. In FIG. 8 illustrates only the inkjet printing unit 41 of the second printing unit 4 similarly to the first printing unit 3 described in the first embodiment.

As illustrated in FIG. 8, the inkjet printing unit 41 includes the inkjet head 411 located to face tablets, an ink supply unit 45, an ink bag 46, and a lifting device 47.

The inkjet head 411 has a nozzle (not illustrated) on a nozzle forming surface 412 to eject ink therefrom, thereby performing printing on the tablets. When maintenance such as purge or dummy ejection is performed, ink is ejected from the nozzle as in the case of the inkjet head 311 of the first embodiment.

The ink bag 46 is an ink tank filled with ink used in a printing process or the like. The ink bag 46 corresponds to the first ink tank. For example, a back for containing a blood product may be used as the ink bag 46. By using such a back, it is possible to prevent foreign matter such as germs from entering the ink as well as to keep the freshness. The ink in the ink bag 46 is supplied to the inkjet head 411 through the ink supply unit 45 and ejected in a printing process or the like.

The ink supply unit 45 supplies the ink supplied from the ink bag 46 to the inkjet head 411. The ink supply unit 45 includes an ink tank 451, a supply pipe 452, and a receiving pipe 453.

The ink tank 451 stores the ink supplied from the ink bag 46 and supplied to the inkjet head 411. The ink tank 451 corresponds to a second ink tank which receives the supply of ink from the ink bag 46. A combination of the second ink tank and the first ink tank corresponds to the ink tank B of the first embodiment.

The ink stored in the ink tank 451 is supplied to the inkjet head 411 as ink is ejected from the nozzle of the inkjet head 411. Ink is supplied from the ink tank 451 to the inkjet head 411 through the supply pipe 452. One end of the supply pipe 452 is connected to an ink supply path 44, and the other end is connected to the bottom surface of the ink tank 451. The ink tank 451 and the ink bag 46 are connected by the receiving pipe 453. Ink is supplied from the ink bag 46 to the ink tank 451 through the receiving pipe 453.

An open/close valve 454 and a throttle 455 are provided in the middle of the receiving pipe 453. By opening and closing the open/close valve 454, it is possible to supply ink from the ink bag 46 to the ink tank 451 or stop the supply. The throttle 455 is located between the open/close valve 454 and the ink tank 451 in the middle of the receiving pipe 453. The throttle 455 is provided to adjust the amount of ink to be supplied to the ink tank 451 by controlling the flow rate thereof when the ink is supplied from the ink bag 46 to the ink tank 451 through the receiving pipe 453.

A pipe 456 is connected to an upper part of the ink tank 451, and is provided with an open/close valve 457. The pipe 456 and the open/close valve 457 are used when exposing the inside of the ink tank 451 to the atmosphere.

Note that the open/close valves 454, 457 and the throttle 455 may be operated manually, or may be operated automatically based on an instruction from the control unit 5.

The inkjet head 411 is connected to the ink supply path 44 for receiving the supply of ink from the ink supply unit 45. That is, one end of the ink supply path 44 is connected to the inkjet head 411, and the other end is connected to the supply pipe 452 of the ink supply unit 45. As the ink supply path 44, for example, a tube having flexibility can be suitably used.

In addition, an open/close valve 441 is provided in the middle of the ink supply path 44 so that ink can be supplied from the ink supply unit 45 to the inkjet head 411 or the supply can be stopped. The open/close valve 441 may be opened and closed manually, or it may be opened and closed under the control of the control unit 5.

In such a configuration, the ink bag 46 of the second embodiment contains, for example, an amount of ink which is used in a day's printing process or the like s and can be used up without being replenished. Therefore, for example, a new ink bag 46 is prepared before the start of the printing process or the like, and the necessary amount of ink is used in the printing process or the like. Then, the ink bag 46 is replaced after the completion of the printing process or the like.

As ink is used up, it is desirable to replace all that the ink touches. Therefore, in addition to the ink bag 46, a supply pipe 461, a pipe joint 462, a pipe joint 459, the receiving pipe 453, the open/close valve 454, the throttle 455, and the ink tank 451 are also replaced. In this case, they may be replaced individually, or the ink supply unit 45 as a whole may be replaced. Besides, the replaced parts may be disposable or reused by washing.

The ink stored in the ink bag 46 is supplied to the ink supply unit 45 like drip infusion. In the supply of ink from the structure of the ink bag 46 to the ink supply unit 45, the ink naturally flows from top to bottom. Accordingly, the positional relationship between the ink bag 46 and the ink supply unit 45 is such that the ink bag 46 is located above the ink supply unit 45.

In the ink bag 46, the supply pipe 461 for supplying ink to the ink supply unit 45 is provided to the lower end of the center of the ink bag 46. However, for example, in order to maintain the supply amount of ink when the amount of ink in the ink bag 46 decreases, if the ink bag 46 is tilted to be used, the supply pipe 461 may be provided at the lowest position of the ink bag 46 when the ink bag 46 is tilted.

The ink bag 46 is supported by a fixture 472 of the lifting device 47 so as to suspend the ink bag 46 to supply ink to the ink supply unit 45 through the supply tube 461.

(Unitization)

The ink supply unit 45 and the ink bag 46 each include their respective constituent parts and are unitized. They are unitized to facilitate the replacement of ink, for example. In order to couple the inkjet head 411 with the ink supply unit 45, and the ink supply unit 45 with the ink bag 46, a pipe joint, which is arranged at an end portion of a tube provided for each, is used.

A pipe joint 442 is provided at the end of the ink supply path 44 connected to the ink supply unit 45. On the other hand, a pipe joint 458 is provided at the end of the supply pipe 452 connected to the inkjet head 411. Accordingly, by connecting the pipe joint 442 and the pipe joint 458 to each other, the ink supply path 44 and the supply pipe 452 are connected. That is, the inkjet head 411 and the ink supply unit 45 are connected, and thus ink can be supplied from the ink supply unit 45 to the inkjet head 411.

The pipe joint 459 is provided at the end of the receiving pipe 453 connected to the ink bag 46. The pipe joint 462 is provided at the end of the supply pipe 461 connected to the ink supply unit 45. Accordingly, by connecting the pipe joint 459 and the pipe joint 462 to each other, the receiving pipe 453 and the supply pipe 461 are connected. That is, the ink supply unit 45 and the ink bag 46 are connected, and thus ink can be supplied from the ink bag 46 to the ink supply unit 45.

The pipe joints 442 and 458 and the pipe joints 459 and 462 are configured to be detachable from each other. Therefore, as the ink supply unit 45 and the ink bag 46 are each unitized, no special technique is required to connect the units, and anyone can easily and reliably connect the units. Further, since the units are connected by using the pipe joints 442, 458, 459, and 462, maintenance can be performed for each of the units. Thus, the simplification of the maintenance process can be achieved.

An open/close valve may be provided between the ink bag 46 and the pipe joint 462 and between the ink tank 451 and the pipe joint 458. With this, when the ink bag 46 and the ink tank 451 are removed, it is possible to prevent the ink remaining inside the ink bag 46 and the ink tank 451 from leaking out by closing the open/close valve.

As described above, by connecting the units of the ink bag 46, the ink supply unit 45, and the inkjet head 411 in this order using the pipe joints 462, 459, 458, and 442, ink can be supplied from the ink bag 46 to the inkjet head 411.

Specifically, ink is supplied from the ink bag 46 to the ink supply unit 45 through the supply pipe 461. In the ink supply unit 45, an open/close valve 454 and the throttle 455 provided in the receiving pipe 453 are each opened and closed, and a necessary amount of ink is supplied from the ink bag 46. By opening the open/close valve 454, ink is supplied from the ink bag 46 to the ink supply unit 45.

The throttle 455 is used to adjust the amount of ink supplied to the ink tank 451. Specifically, the throttle 455 is arranged so as to sandwich the receiving pipe 453. The throttle 455 is configured to change the inner diameter of the receiving pipe 453 to change the flow path resistance, thereby adjusting the flow rate of ink passing through the receiving pipe 453. The throttle 455 functions as a flow path resistance adjusting mechanism.

The throttle 455 is described herein as adjusting the flow rate of ink by changing the inner diameter of the receiving pipe 453 to thereby change the flow path resistance; however, it is not so limited. Any method may be employed as long as the flow rate of ink can be adjusted by changing the flow path resistance.

The ink tank 451 stores ink supplied from the ink bag 46, and supplies the ink to the inkjet head 411 connected through the supply pipe 452.

The height L2 of the ink level in the ink tank 451 is an issue to be considered in relation with the height L1 of the nozzle forming surface 412 of the inkjet head 411. The difference between the two is the head difference h to be controlled. In the second embodiment, the head difference h is maintained at a predetermined value as follows.

As described in the first embodiment, the amount of ink ejected in, for example, a day's printing process or the like can be calculated by taking into account such information as the number of tablets to be printed, the amount of ink ejected for each tablet, and the amount of ink ejected in maintenance such as, for example, dummy ejection or purge. On the other hand, as described above, as the ink is ejected from the nozzle of the inkjet head 411, the height L2 of the ink level in the ink tank 451 is lowered. If the head difference h cannot be maintained due to the lowering of the liquid level of ink, problems such as ejection fault occur in the printing process or the like on tablets.

Therefore, in the second embodiment, the amount of ink supplied from the ink bag 46 to the ink tank 451 is adjusted based on information about the use amount of ink which can be figured out beforehand to keep the ink height L in the ink tank 451 as constant as possible, thereby maintaining the head difference h at a predetermined value. Incidentally, the information about the use amount of ink is, for example, the consumption amount in a printing process.

The amount of ink supplied from the ink bag 46 to the ink tank 451 is adjusted by changing the inner diameter of the receiving pipe 453 by the throttle 455 as described above. By adjusting the throttle 455, the number of ink droplets supplied from the receiving pipe 453 to the ink tank 451 is changed. The amount of ink in one droplet varies depending on the inner diameter of the receiving pipe 453, the viscosity of the ink and the surface tension.

The number "N" of ink droplets supplied to the ink tank 451 per hour can be calculated based on the following equation (1).

[Equation 1]

$$N=X\times L/d \quad (1)$$

In the above equation, "X" indicates the number of tablets to be processed per hour in the tablet printing apparatus S. "L" is the amount of liquid per tablet required for printing on one side of the tablet, and is calculated by multiplying the amount of ink ejected from one nozzle of the inkjet head 411 by the number of dots used for a character or a letter to be printed. Further, "d" indicates the amount of liquid in one ink droplet dropping from the receiving pipe 453 to the ink tank 451 by a drip system. The value of "d" is determined experimentally in advance.

By using equation (1) with these parameters, it is possible to calculate the number "N" of ink droplets per hour supplied from the ink bag 46 to the ink tank 451. The fact that the number of droplets can be figured out means that the amount of ink supplied from the ink bag 46 to the ink supply unit 45 can be figured out in advance. On the basis of information on the amount of ink supplied from the ink bag 46 to the ink supply unit 45 figured out as above, the speed at which ink droplets are dropped from the receiving pipe 453 to the ink tank 451 is determined, and the throttle 455 is adjusted.

By supplying the ink to the ink tank 451 in this manner, even if ink is used by a printing process or the like, the head difference h between the height L1 of the nozzle forming surface 412 of the inkjet head 411 and the height L2 of the ink level in the ink tank 451 can be maintained at a predetermined value.

When the amount of ink in the ink bag 46 decreases, for example, a pressurizing device may be used to ensure the supply amount of ink to the ink tank 451. Examples of the pressurizing device include a device that pressurizes the ink bag 46 from both sides. In addition, the flow rate may be increased at the throttle 455, or the ink bag 46 may be inclined. Further, by checking the reduction speed of ink in the ink bag 46 with a sensor and monitoring whether the reduction speed of ink in the ink bag 46 is decreasing, the amount of ink supplied to the ink tank 451 may be adjusted according to this.

As described above, a larger amount of ink is consumed in maintenance such as dummy ejection or purge than in a printing process. Therefore, when such maintenance is performed, it is preferable to set a consumption amount for maintenance such as dummy ejection, purge, and the like different from the consumption amount during a printing process such that the amount of ink supplied from the ink bag 46 to the ink tank 451 can be adjusted based on the different consumption amount.

In the second embodiment, as described above, the head difference h between the height L1 of the nozzle forming surface 412 of the inkjet head 411 and the height L2 of the ink level in the ink tank 451 is maintained at a predetermined value. Accordingly, as illustrated in FIG. 8, the ink tank 451 is positioned such that the ink level in the ink tank 451 is lower by the head difference h than the nozzle forming surface 412 of the inkjet head 411.

Figure 9:
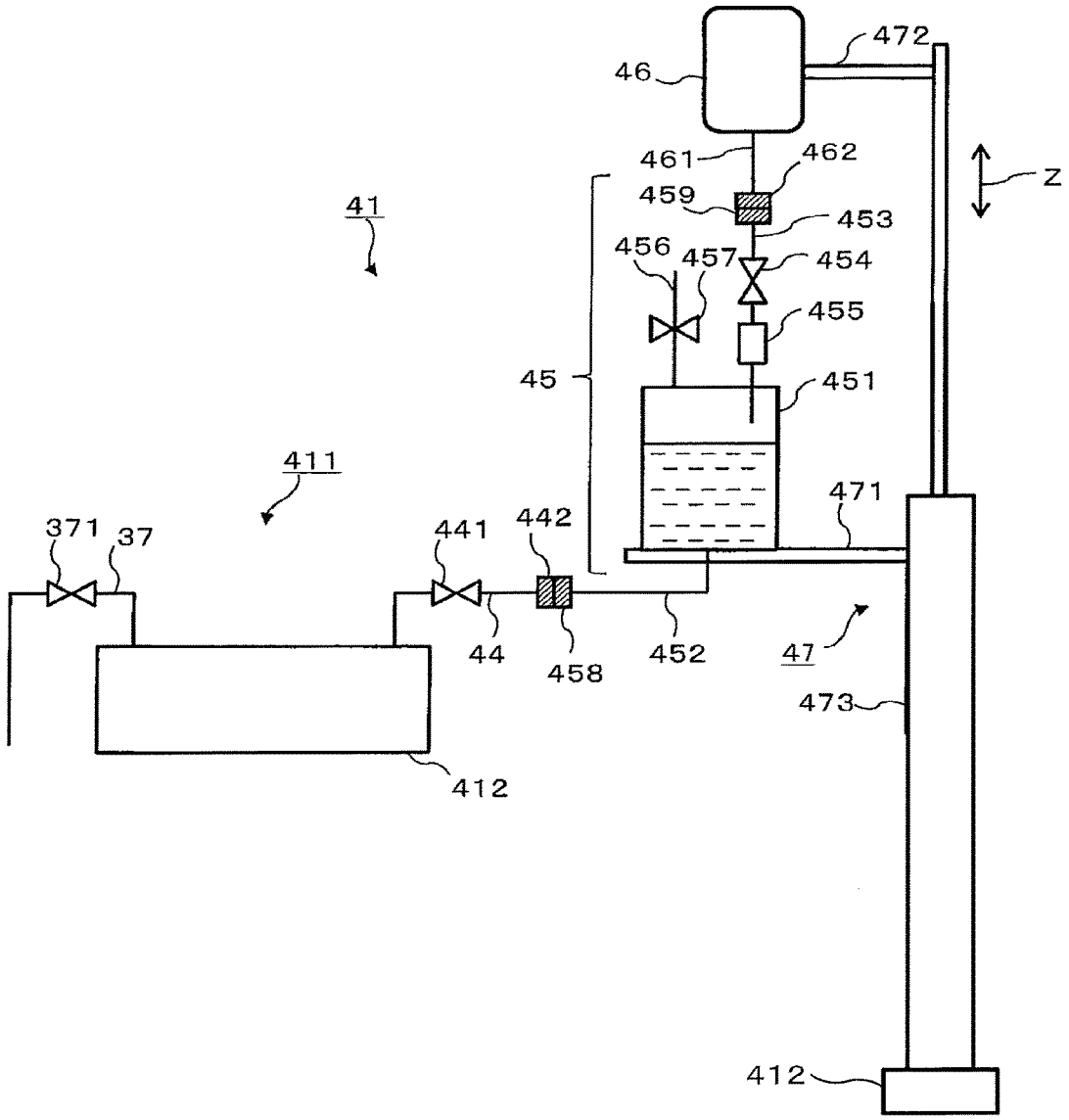
FIG. 9 is a schematic diagram for explaining the movement of an ink tank illustrated in FIG. 8.

FIG. 9 is a schematic diagram illustrating a configuration of the inkjet printing unit 41 of the second printing unit 4 according to the second embodiment. FIG. 9 illustrates the position of each component described above at the time of performing the process of filling the inkjet head 411 with ink using the component.

Incidentally, when filling the inkjet head 411 with ink, a large amount of ink has to be supplied to the inkjet head 411. Therefore, in this case, the ink tank 451 at the position where the head difference h is kept at a predetermined value is arranged such that at least the liquid level in the ink tank 451 is higher than the nozzle forming surface 412. FIG. 9 illustrates a state where the ink supply unit 45 and the ink bag 46 are arranged to be higher than the inkjet head 411.

Here, as illustrated in FIGS. 8 and 9, the lifting device 47 is used to lift and lower the ink supply unit 45 and the ink bag 46 in the Z axis direction. The lifting device 47 includes a placement table 471 on which the ink tank 451 is placed, the fixture 472 for fixing the ink bag 46, a moving mechanism 473 for moving the entire ink supply unit 45 including the ink tank 451 and the ink bag 46 up and down, and a driving device 474 for driving the moving mechanism 473. For example, by moving the placement table 471 and the fixture 472 up and down without changing the distance between them, the ink supply unit 45 and the ink bag 46 can be moved up and down without changing the positional relationship therebetween.

The lifting device 47 is controlled by the control unit 5 illustrated in FIG. 1. The printing process is started at the time of replacement of the ink supply unit 45 and the ink bag 46 or after a filling process. Therefore, as in the first embodiment, the ink supply unit 45 and the ink bag 46 are each moved to the stop position at which the head difference h is a predetermined value by using the sensor K (not illustrated).

In a specific flow of the operation, first, the ink supply unit 45 and the ink bag 46 move up to above the inkjet head 411. Then, the throttle 455 is fully opened. Incidentally, in the receiving pipe 453 through which ink flows, the open/close valve 454 located upstream of the throttle 455 is fully closed at this time. This is because, if the open/close valve 454 is in open, ink is supplied to the inkjet head 411 at an unintended timing when the ink supply unit 45 and the ink bag 46 move upward. At this time, the ink tank 451 is empty. When, for example, maintenance such as purge is performed, the ink tank 451 may not be empty. Therefore, in order to prevent an unintended supply from the ink tank 451, it is desirable to close the open/close valve 441 as well as the open/close valve 454.

Thereafter, all the valves including the open/close valve 441 in the ink supply path 44, the open/close valve 457 located above the ink tank 451, and the valve 371 in the drain pipe 37 are opened. The open/close valve 454 is also opened. As a result, an ink flow path is secured from the ink bag 46 to the inkjet head 411 and further to the drain pipe 37. Then, the inkjet head 411 is filled with the ink. As the inkjet head 411 is filled with the ink, the ink remaining in the inkjet head 411 is drained to the outside of the inkjet head 411 through the drain pipe 37.

After it is checked that the ink has been filled, first, the valve 371 arranged in the drain pipe 37 is closed. Thereafter, the open/close valve 454 and the open/close valve 457 of the ink tank 451 are closed. Then, as illustrated in FIG. 8, the ink supply unit 45 and the ink bag 46 are lowered to a position where the head difference h between the height L1 of the nozzle forming surface 412 of the inkjet head 411 and the height L2 of the ink level in the ink tank 451 becomes a predetermined value, and the apparatus prepares for the start of a printing process or the like.

While FIGS. 8 and 9 illustrate examples of the configuration of the lifting device 47, the configuration of the lifting device 47 is not limited to them. The lifting device 47 may have any mechanism as long as the ink supply unit 45 and the ink bag 46 can be moved up and down. Further, the ink supply unit 45 and the ink bag 46 may be moved up and down separately. Although the ink bag 46 is described as being fixed to the fixture 472 of the lifting device 47 in this embodiment, for example, the fixture 472 may also have a function of maintaining the height of the ink bag 46 at the time of ink supply.

Even in purge in a maintenance process, ink can be supplied from the ink bag 46 to the inkjet head 411 in the flow described above.

Besides, in the filling process and purge, instead of moving the ink bag 46 and the ink supply unit 45 upward, for example, by pressurizing the ink bag 46 from both sides as described above, ink may be forcibly supplied to the inkjet head 411 from the ink bag 46. Further, for example, a pressure feed device such as a compressor may be incorporated between the ink tank 451 and the inkjet head 411. As in the first embodiment, the pressurizing device 35 may be used. In this case, a certain amount of ink is stored in the ink tank 451, and the ink is pressurized. In FIGS. 8 and 9, the supply pipe 452 is illustrated as being connected to the bottom of the ink tank 451; however, it may be inserted from the top of the ink tank as in the first embodiment.

As described above, according to the second embodiment, in order to maintain the head difference h at a predetermined value, the amount of ink supplied from the ink bag 46 to the ink tank 451 is adjusted based on information about the use amount of ink that can be figured out in advance, thereby maintaining the ink height L in the ink tank 451. Thus, the head difference h between the height L1 of the nozzle forming surface 412 of the inkjet head 411 and the height L2 of the ink level in the ink tank 451 can be maintained at a predetermined value. This makes it possible to stabilize the amount of ink ejected from the inkjet head 411 and perform printing on tablets in a satisfactory manner. Thus, it is possible to provide a tablet printing apparatus S and a tablet printing method capable of appropriate printing on a small printing object such as a tablet.

In addition, it is not required to set the upper limit and the lower limit of the amount of ink to be stored in a container for storing ink to maintain the head difference h at a predetermined value, let alone detect the upper limit and the lower limit with a sensor. This eliminates the need of adding a device such as a sensor to the tablet printing apparatus, resulting in a simple apparatus configuration. This increases the degree of freedom in the arrangement of each part constituting the tablet printing apparatus is increased, and facilitates maintenance.

Besides, if the ink bag 46 and the ink tank 451 are pressurized for filling or purge, the lifting device 47 may not be required. Further, if the ink supply amount per unit time is set at first, then the control of the control unit 5 may not be required. However, when the infusion speed needs to be changed during the printing process, the control unit 5 may be used in some cases.

When printing is applied to a small tablet, a slight change in the head difference h causes a large change in the amount of ink ejected. In the second embodiment, the head difference h can be maintained at a predetermined value in almost real time. Therefore, there is no large change in the amount of ink ejected. Thus, printing can be appropriately applied to tablets without blurring or bleeding of the print.

In the second embodiment, as in the first embodiment, the inkjet head 411 is not moved to maintain the head difference h. That is, the inkjet head 411 is fixed during printing on tablets. Accordingly, the interval between the tablets and the inkjet head 411 is set optimal for printing, and the interval does not change. Thus, the distance at which ejected ink reaches the tablet is kept constant. Thereby, clear printing can be performed even on a small tablet.

As described above, in the first embodiment, in order to maintain the head difference h at a predetermined value, the ink tank B is moved up according to the consumption amount of ink figured out in advance to thereby cancel a liquid level drop caused along with the consumption of ink. On the other hand, in the second embodiment, in order to maintain the head difference h at a predetermined value, a predetermined amount of ink, which is set based on the consumption amount of ink figured out in advance, is supplied to the ink tank 451 to thereby cancel a liquid level drop caused along with the consumption of ink. In any of these controls, as described above, the predetermined value of the head difference h is set within a predetermined acceptable range. Thus, it is possible to maintain the head difference h at the predetermined value and keep it within the predetermined acceptable range. This makes it possible to stabilize the amount of ink ejected from the inkjet head (311,411) and perform printing on tablets in a satisfactory manner.

Other Embodiments

In any of the above embodiments, it is preferable to provide an opening door on the side where the operator of the printing apparatus is positioned, and arrange a holder for holding the ink tank (B, 60, 70, 451) inside the opening door. With such a configuration, when the ink tank (B, 60, 70, 451) is replaced, the opening door is opened to the front, whereby the ink tank (B, 60, 70, 451) is pulled out to the operator side. This facilitates the replacement of the ink tank (B, 60, 70, 451) and visual checking of the ink consumption state. Incidentally, the placement table (361, 381, 471) functions as the holder.

It is also preferable to provide the opening door with a window for observation so that the ink tank (B, 60, 70, 451) can be seen through the window. With this, the ink consumption state can be visually checked without opening the door each time. An illumination for observation may be provided in the apparatus or light of illumination for the imaging apparatus may be used. In this case, the ink tank (B, 60, 70, 451) may be held in a place where the light of the illumination for the imaging device can reach. By letting the light pass through the ink tank (B, 60, 70, 451), the observation of the liquid level is further facilitated. By providing a slit between the ink tank (B, 60, 70, 451) and the illumination such that only the liquid level can be seen by the transmitted light, the visibility is further improved. This eliminates the need of a sensor for constantly detecting the liquid level, resulting in a simple apparatus configuration. Detection may be difficult with a sensor depending on the type of ink. However, the consumption state can be checked visually regardless of the type of ink.

In each of the above embodiments, tablets are conveyed by using the conveyor belt (13, 23); however, it is not so limited. For example, tablets may be placed on a pallet or the like, and printing may be performed by conveying the pallet. Alternatively, tablets may be sucked and held on the surface of a rotary drum and conveyed. Any transport mechanism may be used as long as it has a configuration in which a tablet and the inkjet head (311, 411) move relative to each other to enable printing.

Further, a method has been described in which ink is filled by pressurizing from the tank side in the case of, for example, performing the filling process for the inkjet head (311, 411) or performing purge. Alternatively, ink may be filled by providing a tank in the drain pipe which is connected to the inkjet head (311, 411), and applying a negative pressure to the tank such that ink is fed from the ink tank (B, 60, 70, 451) to the inkjet head (311, 411).

Examples of the tablet include a plain tablet (uncoated tablet), a sugar-coated tablet, a film-coated tablet, an enteric coated tablet, a gelatin coated tablet, a multilayered tablet, a dry-coated tablet, and the like. Examples of the tablet further include various capsule tablets such as hard capsules and soft capsules. While the tablet has been described assuming that it is for pharmaceutical use and edible use, examples of the tablet also include those for cleaning, industrial use, and aromatic use.

In the case where tablets to be printed are for pharmaceutical use and edible use, edible ink is suitably used. Specifically, edible pigments such as Amaranth, Erythrosine, New Coccine (red pigments), Tartrazine, Sunset Yellow FCF, β-Carotene, Crocin (yellow pigments), Brilliant Blue FCF, Indigo Carmine (blue pigments), or the like are dispersed or dissolved in a vehicle, and, if necessary, a pigment dispersant (surfactant) is blended therein, the resultant of which can be used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:
a conveyor;
an inkjet head configured to eject ink from a nozzle to a tablet conveyed by the conveyor to perform printing;
an ink tank configured to contain the ink to be supplied to the inkjet head;
a moving device configured to change a height of the ink tank; and
a control unit configured to control the moving device,
wherein the control unit is further configured to control the moving device to change the height of the ink tank based on a use amount of the ink figured out in advance to maintain a head difference between a height of liquid level of the ink in the ink tank and a height of a nozzle forming surface, where the nozzle is formed in the inkjet head, at a predetermined value.

2. The tablet printing apparatus according to claim 1, wherein the moving device includes:
a placement table on which the ink tank is placed;
a moving mechanism configured to move the placement table; and
a driving device configured to drive the moving mechanism.

3. The tablet printing apparatus according to claim 1, wherein the use amount of the ink figured out in advance is an amount of ink consumed per the number of printed tablets or per unit time of a printing process.

4. The tablet printing apparatus according to claim 1, wherein the control unit is further configured to predict an amount of liquid level drop in the ink tank based on the use amount of the ink figured out in advance, and control the moving device to move the ink tank upward to cancel the liquid level drop predicted.

5. The tablet printing apparatus according to claim 1, wherein the control unit is further configured to control the moving device to move the ink tank upward while the ink is being ejected from the nozzle.

6. The tablet printing apparatus according to claim 1, wherein one end of an ink supply path to supply the ink from the ink tank to the inkjet head is connected to an upper part of the ink tank.

7. A tablet printing apparatus, comprising:
a conveyor;
an inkjet head configured to eject ink from a nozzle to a tablet conveyed by the conveyor to perform printing;
an ink tank configured to contain the ink to be supplied to the inkjet head;
a moving device configured to change a height of the ink tank; and
a control unit configured to control the moving device,
wherein the control unit is further configured to control the moving device to rotate the ink tank so as to maintain a height of liquid level of the ink based on a use amount of the ink figured out in advance to maintain a head difference between the height of the liquid level of the ink in the ink tank and a height of a nozzle forming surface, where the nozzle is formed in the inkjet head, at a predetermined value.

8. The tablet printing apparatus according to claim 7, wherein the use amount of the ink figured out in advance is an amount of ink consumed per the number of printed tablets or per unit time of a printing process.

9. The tablet printing apparatus according to claim 7, wherein the control unit is further configured to predict an amount of liquid level drop in the ink tank based on the use amount of the ink figured out in advance, and control the moving device to rotate the ink tank upward to cancel the liquid level drop predicted.

10. The tablet printing apparatus according to claim 7, wherein a rotation axis, about which the ink tank is rotated, is located on an extension line of the height of the liquid level in the ink tank at which the head difference from the nozzle forming surface is set.

11. A tablet printing apparatus, comprising:
a conveyor;
an inkjet head configured to eject ink from a nozzle to a tablet conveyed by the conveyor to perform printing;
a first ink tank filled with the ink; and
an ink supply unit including a second ink tank connected to the first ink tank through a pipe and configured to store the ink, and a flow path resistance adjusting mechanism configured to adjust an amount of the ink supplied from the first ink tank to the second ink tank, the ink supply unit configured to supply the ink from the second ink tank to the inkjet head,
wherein the flow path resistance adjusting mechanism is further configured to adjust an amount of the ink by moving the ink from the first ink tank to the second ink tank based on a use amount of the ink figured out in advance to maintain a head difference between a height of liquid level of the ink in the second ink tank and a height of a nozzle forming surface where the nozzle is formed at a predetermined value.

12. The tablet printing apparatus according to claim 11, wherein a connection portion of the first ink tank and the ink supply unit, and a connection portion of the ink supply unit and the inkjet head are each formed of a detachable pipe joint.

13. The tablet printing apparatus according to claim 11, wherein the use amount of the ink figured out in advance is an amount of ink consumed per the number of printed tablets or per unit time of a printing process.

14. The tablet printing apparatus according to claim 11, wherein the first ink tank is located above the second ink tank.

* * * * *